US009599016B2

(12) United States Patent
Lippitt

(10) Patent No.: US 9,599,016 B2
(45) Date of Patent: Mar. 21, 2017

(54) INTERNAL COMBUSTION ENGINES

(71) Applicant: Raymond F. Lippitt, Smithfield, NC (US)

(72) Inventor: Raymond F. Lippitt, Smithfield, NC (US)

( * ) Notice: Subject to any disclaimer, the term of this patent is extended or adjusted under 35 U.S.C. 154(b) by 0 days.

(21) Appl. No.: 14/402,001

(22) PCT Filed: Mar. 15, 2013

(86) PCT No.: PCT/US2013/031956
§ 371 (c)(1),
(2) Date: Nov. 18, 2014

(87) PCT Pub. No.: WO2013/172973
PCT Pub. Date: Nov. 21, 2013

(65) Prior Publication Data

US 2015/0167548 A1 Jun. 18, 2015

Related U.S. Application Data

(60) Provisional application No. 61/768,127, filed on Feb. 22, 2013.

(51) Int. Cl.
*F02B 41/08* (2006.01)
*F02B 75/28* (2006.01)
(Continued)

(52) U.S. Cl.
CPC ..... *F02B 75/28* (2013.01); *F01B 7/14* (2013.01); *F02B 25/04* (2013.01); *F02B 25/08* (2013.01);
(Continued)

(58) Field of Classification Search
CPC ..... F02B 75/28; F02B 75/18; F02B 75/246; F02B 2075/025; F02B 23/10; F02B 25/04;
(Continued)

(56) References Cited

U.S. PATENT DOCUMENTS 1,681,910 A 8/1928 Slaght
2,110,248 A * 3/1938 Wagner ..... F02B 41/06 123/52.3
(Continued)

FOREIGN PATENT DOCUMENTS

GB 301677 12/1928

OTHER PUBLICATIONS

International Search Report for PCT/US2013/031956 dated Aug. 7, 2013.
(Continued)

*Primary Examiner* — Lindsay Low
*Assistant Examiner* — George Jin
(74) *Attorney, Agent, or Firm* — Pillsbury Winthrop Shaw Pittman, LLP

(57) ABSTRACT

This invention relates to internal combustion engines and more particularly to internal combustion engines and methods of operating the engines with a new fuel saving cycle. Various embodiments use a passage between adjacent cylinders to enable a mode in which fuel combusted in one cylinder supplies pressure to the other that has not been supplied with fuel, thus enabling driving of both cylinders with less fuel.

53 Claims, 15 Drawing Sheets

(51) Int. Cl.

| | |
|---|---|
| ***F02B 33/22*** | (2006.01) |
| ***F02B 75/24*** | (2006.01) |
| ***F02B 33/44*** | (2006.01) |
| ***F02B 41/06*** | (2006.01) |
| ***F02B 25/08*** | (2006.01) |
| ***F02B 25/04*** | (2006.01) |
| ***F01B 7/14*** | (2006.01) |
| ***F02B 75/18*** | (2006.01) |

(52) U.S. Cl.
CPC ..... *F02B 33/22* (2013.01); *F02B 33/44* (2013.01); *F02B 41/06* (2013.01); *F02B 41/08* (2013.01); *F02B 75/18* (2013.01); *F02B 75/246* (2013.01)

(58) Field of Classification Search
CPC ..... F02B 25/08; F02B 33/44; F02B 33/22; F02B 41/06; F02B 41/08; F02B 41/02; F02B 75/02; F01B 7/14; F02M 26/01; F02D 19/10
USPC ..... 123/70 R, 52.1, 52.2, 52.3, 22 R, 27 R
See application file for complete search history.

(56) References Cited

U.S. PATENT DOCUMENTS

| | | | | |
|---|---|---|---|---|
| 2,269,948 | A | 1/1942 | Mallory | |
| 3,472,212 | A | 10/1969 | Chamberlain | |
| 3,623,463 | A | 11/1971 | Vries | |
| 3,880,126 | A | 4/1975 | Thurston et al. | |
| 4,170,970 | A | 10/1979 | McCandless | |
| 4,172,434 | A | 10/1979 | Coles | |
| 4,250,850 | A | 2/1981 | Ruyer | |
| 4,955,328 | A | 9/1990 | Sobotowski | |
| 5,022,353 | A | 6/1991 | Kamamura | |
| 5,056,471 | A * | 10/1991 | Van Husen | F02B 75/18 123/51 R |
| 5,152,257 | A * | 10/1992 | Blount | F01C 9/007 123/45 A |
| 5,542,382 | A * | 8/1996 | Clarke | F01L 9/021 123/51 AA |
| 6,209,495 | B1 | 4/2001 | Warren | |
| 6,338,328 | B1 | 1/2002 | Mower et al. | |
| 6,363,907 | B1 | 4/2002 | Arai et al. | |
| 6,978,204 | B2 | 12/2005 | Surnilla et al. | |
| 6,988,471 | B2 | 1/2006 | Chang | |
| 6,994,057 | B2 | 2/2006 | Loth et al. | |
| 7,080,615 | B2 | 7/2006 | Shinogle | |
| 7,219,634 | B2 | 5/2007 | Hitomi et al. | |
| 7,383,797 | B2 | 6/2008 | Tour | |
| 7,578,267 | B2 | 8/2009 | Hofbauer et al. | |
| 7,685,988 | B2 | 3/2010 | Almkvist et al. | |
| 7,823,547 | B2 | 11/2010 | Forner, Sr. et al. | |
| 7,954,472 | B1 | 6/2011 | Sturman | |
| 7,958,864 | B2 | 6/2011 | Sturman | |
| 8,006,656 | B2 | 8/2011 | Branyon et al. | |
| 8,051,811 | B2 | 11/2011 | Phillips | |
| 8,132,546 | B2 | 3/2012 | Surnilla | |
| 8,156,904 | B2 | 4/2012 | Giannini et al. | |
| 8,443,769 | B1 | 5/2013 | Lippitt | |
| 8,899,193 | B2 | 12/2014 | Lippitt et al. | |
| 9,026,339 | B1 | 5/2015 | Sturman | |
| 2004/0099887 | A1* | 5/2004 | Hazelton | F02B 41/06 257/232 |
| 2005/0022755 | A1* | 2/2005 | Hitomi | F01L 1/185 123/58.8 |
| 2006/0102124 | A1 | 5/2006 | Calderwood | |
| 2008/0029057 | A1 | 2/2008 | Hergart et al. | |
| 2009/0020103 | A1 | 1/2009 | Van Avermaete | |
| 2009/0145396 | A1 | 6/2009 | Almkvist et al. | |
| 2009/0183699 | A1* | 7/2009 | Sturman | F02B 21/00 123/63 |
| 2009/0266329 | A1* | 10/2009 | Cleeves | F01L 5/06 123/190.13 |
| 2010/0050978 | A1 | 3/2010 | Hofbauer | |
| 2010/0056327 | A1* | 3/2010 | Hofbauer | B60K 6/40 477/5 |
| 2010/0229806 | A1 | 9/2010 | Kemeny | |
| 2010/0229836 | A1 | 9/2010 | Hofbauer et al. | |
| 2010/0284824 | A1 | 11/2010 | Hippen et al. | |
| 2010/0308685 | A1 | 12/2010 | Hippen et al. | |
| 2010/0326394 | A1 | 12/2010 | Hofbauer | |
| 2011/0022289 | A1 | 1/2011 | Hofbauer | |
| 2011/0057049 | A1 | 3/2011 | Hofbauer et al. | |
| 2011/0215575 | A1 | 9/2011 | Hofbauer et al. | |
| 2011/0220075 | A1* | 9/2011 | Meldolesi | F02B 33/22 123/70 R |
| 2011/0220080 | A1 | 9/2011 | Meldolesi et al. | |
| 2011/0241473 | A1 | 10/2011 | Hippen et al. | |
| 2011/0251773 | A1 | 10/2011 | Sahandiesfanjani et al. | |
| 2012/0073538 | A1 | 3/2012 | Hofbauer | |
| 2012/0085302 | A1 | 4/2012 | Cleeves | |
| 2012/0085305 | A1 | 4/2012 | Cleeves et al. | |
| 2012/0125298 | A1* | 5/2012 | Lemke | F01B 7/14 123/51 B |
| 2015/0136069 | A1 | 5/2015 | Lippitt | |
| 2015/0136083 | A1 | 5/2015 | Lippitt | |
| 2015/0142291 | A1 | 5/2015 | Lippitt et al. | |
| 2015/0167548 | A1 | 6/2015 | Lippitt | |

OTHER PUBLICATIONS

International Search Report and Written Opinion dated Aug. 18, 2015 for Appln. No. PCT/US2015/033561.
Split Cycle Engine, obtained from url: <http://en.wikipedia.org/wiki/Split_cycle_engine> on Apr. 26, 2012.
Scuderi Engine, obtained from url: <http://en.wikipedia.org/wiki/Scuderi_Engine> on Apr. 26, 2012.
EcoMotors International Technology, obtained from url: <http://www.ecomotors.com/technology> on May 10, 2012.
Australian Office Action dated Jun. 21, 2016 for Appln. No. 2013263355.

* cited by examiner

INTERNAL COMBUSTION ENGINES

CROSS-REFERENCE TO RELATED APPLICATIONS

This is the U.S. National stage of PCT/US2013/031956, filed Mar. 15, 2013, which in turn claims priority to U.S. application Ser. No. 13/475,253, filed May 18, 2012, and U.S. Provisional Appln. Ser. No. 61/768,127, filed Feb. 22, 2013. Each of these applications is incorporated herein by reference in their entirety.

FIELD OF THE INVENTION

This invention relates to internal combustion engines and more particularly to internal combustion engines and methods of operating the engines with a new fuel saving cycle.

BACKGROUND OF THE INVENTION

The present economic condition is particularly bad with respect to gasoline and diesel fuel for cars and heavy trucks. While efforts are being made to provide hybrid automobiles that can operate on rechargeable batteries at least part of the time, nevertheless most still have engines as well that must rely upon gasoline or diesel fuel. The need to make engines more efficient still exists particularly because of rising gasoline and diesel fuel costs.

BRIEF DESCRIPTION OF THE INVENTION

It is an object of the present invention to provide an internal combustion engine which achieves a measure of fulfillment of the need for more efficient and fuel saving engines.

In accordance with the principles of this inventions this objective is achieved by providing an engine which includes at least two piston and cylinder assemblies preferably adjacent to one another, at least one of which includes a fuel injector and both of which are connected to a crank shaft so that the pistons of both assemblies move simultaneously through repetitive cycles each, including simultaneous compression strokes and immediately following simultaneous power drive strokes. The two assemblies, when operating with the new fuel savings cycle, establish at the end of the simultaneous compression strokes a charge of compressed air in one cylinder of one of the assemblies and a charge of compressed air fuel mixture in the other cylinder of the other assembly. When the air fuel mixture is ignited, the high pressure conditions in the other cylinder are immediately communicated through a passage to the one cylinder to accomplish a double expansion during the simultaneous power drive strokes thus using much of the pressure energy before exhaust occurs by the pistons themselves rather than to dump it as is usually done.

Preferably, the engine includes a second fuel injector which is controlled selectively with respect to the first fuel injector to operate in accordance with a normal mode where both assemblies are simultaneously operated alike in which case both cylinders establish a charge of compressed air-fuel mixture at the ends of the simultaneous compression strokes so that in effect a double charge can be ignited to act on both pistons simultaneously.

The invention can be embodied in engines in which the injections made by the injectors cause the ignition (as in conventional compression ignition) or in which the injections are made during simultaneously intake strokes and ignition is made by a spark ignition system. In the case of spark ignition, under normal mode operation the ignition of the second air fuel charge is ignited by a high pressure flame resulting from the ignition in the first cylinder extending through the passage.

The engines embodying the principles of the present invention can be operated either on a four cycle basis or a two cycle basis.

The invention is most easily applicable to engines of the opposed piston type. A particularly efficient embodiment utilizes the opposed pistons in one cylinder type of setup utilized in the new Eco Motors (located in Allen Park, Mich.) engine. The Eco Motors set up includes two cylinders disposed on opposite sides of a central portion of the crankshaft. The central portion of the crankshift is connected to a pair of connecting rods so as to move a pair of pistons one within each cylinder in two stroke cycles out of phase 180° with respect to one another. An opposing piston is mounted in the cylinders, each of which is constrained to move in a cooperating two stroke cycle by a pair of parallel elongated connecting rods pivoted to an opposing piston and to the crankshaft so as to be 180° out of phase with respect to one another.

The Eco Motors engine is advertised as being modular. A dual modular engine includes two modular engines connected together by a clutch assembly. The dual modular engine is comparable to the eight cylinder engines capable of operating on four cylinders only to save fuel. Thus, instead of four non-fueled piston and cylinder assemblies simply going through the motions, the clutch makes it possible to render one modular engine totally inoperable.

One of the objects of the present invention is to reconfigure the Eco Motors dual modular with clutch engine (or another similar such engine) and achieve selective normal operation and fuel saving operation in an improved new cycle way so that the reconfiguration saves parts and the new cycle is more efficient when compared with the dual modular Eco Motors engine and its operation in fuel saving mode.

In accordance with the principles of the present invention the above objective is achieved by abandoning the modular idea and mounting two side by side cylinders on opposite sides of a single central crank shaft so that in each pair of cylinders a pair of opposed pistons move simultaneously through the same two stroke cycle. In this way the events occurring in each pair of side by side cylinders are the same but 180° out of phase with one another. The fuel saving mode is accomplished simply by providing a passage between each pair of side by side cylinders at the central combustion chamber areas, and then reprogramming the computer operated fuel injectors so that one of the two injectors for the two cylinders does not inject instead of both injecting as in normal operation. Consequently, in fuel saving mode the one cylinder which receives an injection when ignited will immediately communicate the resulting high pressure conditions through the passage to the other cylinder to raise the charge of air therein at compression pressure. With the pressure created by the one ignition acting on two pistons to effect simultaneous power drive strokes of two pistons a double working pressure expansion occurs, thus utilizing much of the pressure energy that usually is dumped to exhaust.

Another related aspect of the invention provides an internal combustion engine comprising: a frame structure, a pair of piston and cylinder assemblies mounted on said frame structure including two side by side cylinders and pistons movably mounted in the cylinders for simultaneous movements through repetitive cycles, each including simultaneous compression strokes and immediately following simultaneous power drive strokes, and an output shaft connected with said pistons so as to be moved by the pistons through a predetermined number of rotational movements during each cycle of movement of the pistons. A fuel injection and charge ignition system includes an injector operatively associated with one of the piston and cylinder assemblies and another injector operatively associated with the other of the piston and cylinder assemblies. The fuel injection and charge ignition system is constructed and arranged in one mode of operation to establish at the beginning of the simultaneous power drive strokes of the pistons of both cylinders a charge of ignitable compressed air fuel mixture in one of the cylinders and a charge of unignitable compressed air in the other of the cylinders. A passage between the side-by-side cylinders communicates the high pressure conditions created by the ignition of the charge of ignitable air-fuel mixture in the one of the cylinders with the charge of compressed air to raise the pressure in the other of the cylinders during the one mode to move the number of the pistons associated therewith through the simultaneous drive stroke thereof.

The fuel injection and charge ignition system is constructed and arranged to operate in a second mode of operation to establish at the beginning of the simultaneous power drive strokes a charge of ignitable compressed air-fuel mixture in both cylinders so that the ignition of both ignitable charges moves the pistons of both assemblies together through the simultaneous power drive strokes thereof. A controller is provided for selecting between the first and second modes of operation for the fuel injection and charge ignition system.

Aspects of the present application also relate to dual mode improvements in engines of the type contemplated by Pinnacle Engines, Inc. as exemplified in the following Pinnacle patent disclosures, each of which is hereby incorporated by reference into the present application: US Pat Appln. Pub. No. 2009/0266329 Dated Oct. 29, 2009; US Pat. Appln. Pub. No. 2010/0147269 Dated Jun. 17, 2010; US Pat. Appln. Pub. 2010/0212622 Dated Aug. 26, 2010; US Pat. Appln. Pub. No 2011/0041799 Dated Feb. 24, 2011; US Pat. Appln. Pub. 2011/0220058 Dated Sep. 15, 2011; US. Pat. Appln. Pub. No. 2012/0085302 Dated Apr. 12, 2012; and US Pat. Appln. Pub. No. 2012/0085305 Dated Apr. 12, 2012.

A typical Pinnacle type engine as disclosed in the cited disclosures includes a plurality of opposed piston and cylinder assemblies in which the cylinder of the assembly is made up of two cylinder sections movable separately toward and away from one another to seal off and open a centrally located inlet by one cylinder section and a centrally located outlet to the other cylinder section. A distinct feature of the Pinnacle engine is the ability to move one of the crankshaft driven piston units of one assembly toward and away from the opposed crankshaft piston driven unit of the other assembly to thereby change the compression ratio within the cylinders as between the two assemblies. While the patent disclosures of the Pinnacle type engine attributes various advantages to these features, the arrangement does not provide for selective operation in a normal mode or in a fuel saving mode where fuel injection is cut off.

In a fuel saving mode, one example of this type of dual mode operation is the type presently built into eight cylinder engines wherein four of the eight cylinders are not fed fuel as they go through their cyclical movements. Another example is to provide two unitized engines with a clutch between them enabling one to be completely shut down. See, for example, US Pat. Appln. Pub. No. 2010/0056327. Both of these examples involve disruption of operation and non use of parts.

The present invention contemplates the provision in a Pinnacle type engine of a dual mode of operation in an improved manner where all parts function in both modes; which renders the engine in fuel saving mode to be more efficient while allowing full variable Pinnacle operation. The improvement of the present invention contemplates the use of the underlying principles of the dual mode of operation discussed above and with respect to example embodiments disclosed below, and also disclosed in my pending U.S. patent application Ser. No. filed 13/475,253 filed May 18, 2012. That application is hereby incorporated by reference into the present application. Thus, two piston and cylinder assemblies which in normal mode operate separately in usual fashion have a fuel saving mode wherein only one assembly fed fuel is fired and the high pressure conditions created by the firing are transmitted to the other assembly to drive it simultaneously, the increased expansion being more efficient.

The present invention contemplates allowing each one of two parallel piston and cylinder assemblies of a Pinnacle type engine to operate at all times 180° out of phase with each other with all variables and to add a two stroke piston and cylinder assembly valved by piston movement between the two four stroke pinnacle assemblies. The two stroke assembly is constructed (1) so that the fuel component normally fed thereto can be selectively cut off, leaving the internal pressure condition at normal firing time simply air under compression pressure, and (2) so that alternately this compression air pressure condition can be alternately communicated with the combustion chamber of a 4 stroke assembly during the firing stroke thereof so as to drive the two stroke assembly through a simultaneous increased pressure drive stroke.

The two stroke assembly preferably has a displacement greater than the four stroke assemblies. It can be seen that in normal operation, the two stroke assembly is fed fuel twice during one feed of fuel to each 4 stroke assembly. Consequently, when the fuel saving mode is in operation the two fuel feeds to the two stroke assembly are saved, and there is a fuel saving of at least one half when compared with normal. Moreover, the added expansion by the two stroke assembly during each four stroke assembly cycle serves as an efficiency booster in the fuel saving mode.

Others objects, features and advantages of the present disclosure will become apparent from the following detailed description, the accompanying drawings, and the appended claims.

DETAILED DESCRIPTION OF THE INVENTION

Figure 1:
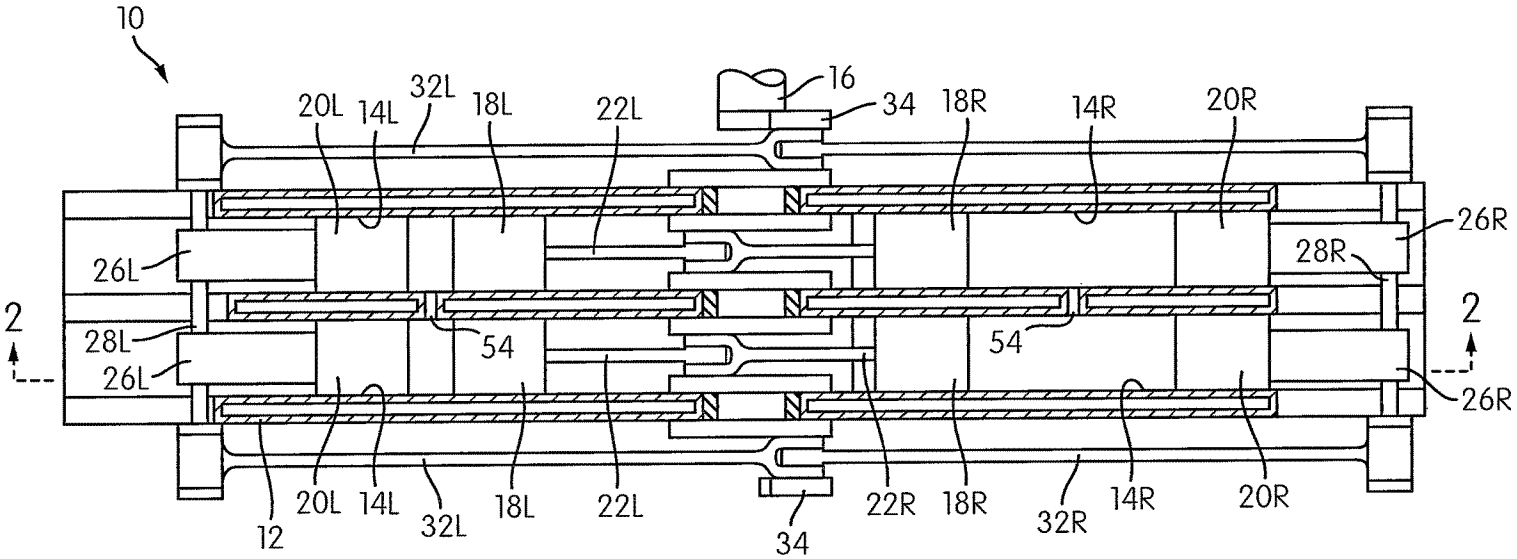
FIG. 1 is a horizontal sectional view of an internal combustion engine embodying the principles of the present invention.
Figure 2:
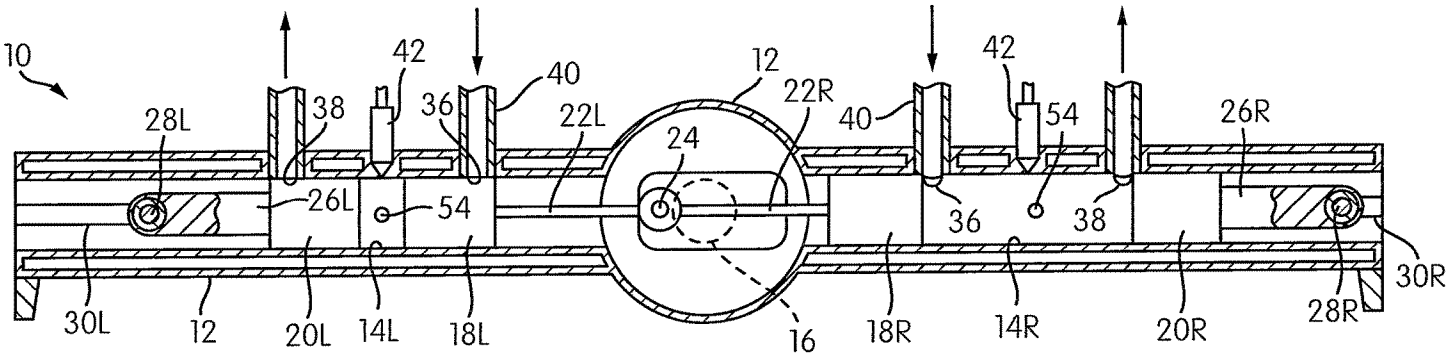
FIG. 2 is a section view taken alone the line 2-2 of FIG. 1.

Referring more particularly to the drawings, there is shown in FIGS. 1 and 2 there of an internal combustion engine, generally indicated at 10, that embodies the principles of the present invention.

The engine 10 includes a main frame structure 12 shown illustratively as one piece in the drawings. In actuality, the frame may be made up of many conventional pieces. In the illustrative one piece embodiment shown the frame structure defines pairs of side by side cylinders 14L and 14R disposed in general alignment on opposite sides of an output crank shaft 16. Mounted within the pairs of cylinders 14L and 14R are pairs of opposed pistons 18L and 20L and 18R and 20R respectively.

The pair of pistons 18L are slidably sealingly mounted in the pair of cylinders 14L for simultaneous movements together toward and away from the crank shaft 16 by a pair of connecting rods 22L pivotally connected at one of their ends to the pair of pistons 18L (as by wrist pins not shown) with their opposite ends rotatably mounted on two aligned interior cranks 24 of the crank shaft 16.

The pair of pistons 18R are slidably sealingly mounted in the pair of cylinders 14 R for simultaneous movements together toward and away from the crank shaft 16 by a pair of connecting rods 22R pivotally connected at one of their ends to the pair of pistons 18R (as by wrist pins not shown) with their opposite forked ends rotatably mounted on the two interior cranks 24.

The pair of pistons 20L are slidably sealingly mounted in the pair of side by side cylinders 14L outwardly of the pair of pistons 18L therein for simultaneous movements toward the pistons 18L as the pistons 18L move away from the crankshaft 16 and away from the pistons 18L as the pistons 18L move toward the crank shaft 16.

The simultaneous movements of the pair of pistons 20L is accomplished by a pair of fixed rods 26L extending outwardly of the pair of pistons 20L and having a shaft 28L extending transversely therethrough so as to be relatively pivoted with respect to the piston rods 26L about the axis of the shaft 28L. The shaft 28L moves within three axially spaced slots 30L formed in the adjacent end of the frame structure 12 as shown, the central portion of the shaft 28L extending between the spaced connecting rods 26L slides in the central slot 30L and opposite ends of the shaft 29L extend outwardly of the rods 26L through the outer two slots 30L and then beyond the adjacent frame structure 12.

Pivoted to the outwardly extending ends of the shaft 28L are one of the ends of a pair of exterior connecting rod's 32L. The pair of exterior connecting rods 32L extend inwardly toward the crank shaft 16 and have their inner ends rotatably connected to two exterior cranks 34 on the opposite ends of the crank shaft 16 transversely outwardly of the adjacent frame structure 12.

The pair of outer pistons 20R are related to the pair of inner pistons 18R and move simultaneously together and away from one another by a similar assembly of components including piston rods 26R, shaft 28R moving in slots 30R and a pair of exterior connecting rods 32R having their inner ends rotatably connected to the cranks 34 of the crank shaft 16 and their outer ends pivotally connected with outer ends of the shaft 28R.

It can be seen from the connection of the connecting rods 22L and 22R, between the crank shaft 16 and inner pairs of pistons 18L and 18R and the connection of the exterior connecting rods 32L and 32R between the crank shaft 16 and the outer pairs of pistons 20L and 20R, the pairs of pistons 18L and 20L move simultaneously trough two stroke repetitive cycles each including (1) a compression stroke wherein the pairs of pistons 18L and 20L move from an outer limiting position spaced widely apart toward one another into inner limiting position spaced apart but almost together and (2) a power drive stroke wherein the pairs of pistons 18L and 20L move from the inner limiting position to the outer limiting position away from one another.

The pairs of pistons 18R and 20R have a similar two stroke repetitive cycle. However, since they are connected to the same cranks of the crank shaft 16 (i.e., at the same crank axis), the two stroke cycle thereof is displaced 180° from the two stroke cycle of the pairs of pistons 18L and 20L. Stated differently, the pistons 18L and 20L move through a compression stroke while the pistons 18R and 20R move through a power drive stroke and when the pistons 18L and 20L move through a power drive stroke the pistons 18R and 20R move through a compression stroke.

The pistons 18L-20L and 18R-20R are moved through repetitive out of phase two stroke cycles during each revolution of the crankshaft 16 because during the time when the pistons are near the outer limiting positions a flow of air under pressure is made to pass into one end of each pair of side by side cylinders 14L or 14R through an inlet opening 36 in each cylinder 14 and out an outlet opening 38 at the opposite end of each cylinder. Conversely, the pistons in the other cylinders are in the inner limiting position and the openings 36, 36 are closed off.

Figure 3:
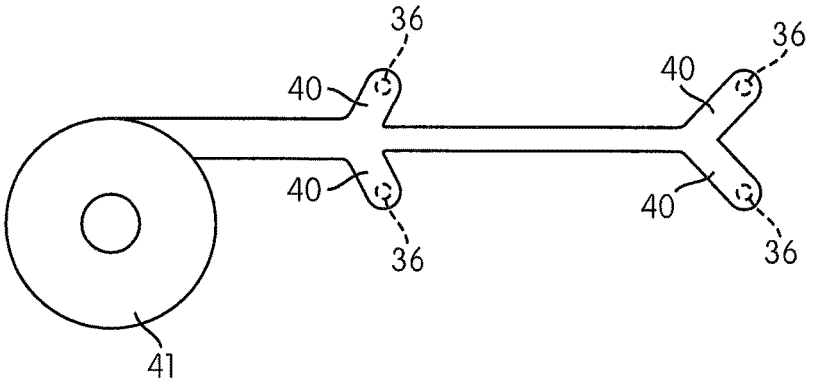
FIG. 3 is a schematic view showing a pressurized air intake system.

FIG. 3 illustrates schematically how a pump 41 (suitable to be driven by the output shaft 16) feeds a pressurized flow of air through tubes to each inlet opening 36 when the inlet openings and outlet openings 38 are opened in accordance with known practice by the movement of the associated pistons 18 or 20 thereby near the end of the power drive strokes thereof.

As the pistons 18 and 20 move through the initial portion of their compression stroke, the pressurized air that has moved into the cylinders 14 is trapped therein because the pistons move past the openings 36 and 38 in the opposite direction to close them. The trapped air is then pressurized as pistons 18 and 20 move together in their compression stroke.

In the embodiment shown, the compression ratio is chosen so that when the pistons 18 and 20 reach near or at their inner limiting positions, the pressure and temperature conditions of the air is such that an injection of fuel also causes compression ignition to occur.

As shown in the drawings, there is a fuel injector 42 carried by the frame structure 12 in association with each cylinders 14 is positions so that its nozzle enters within the cylinder 14 in the combustion chamber space between the pistons 18 and 20 when in their inner limiting positions.

Figure 4:
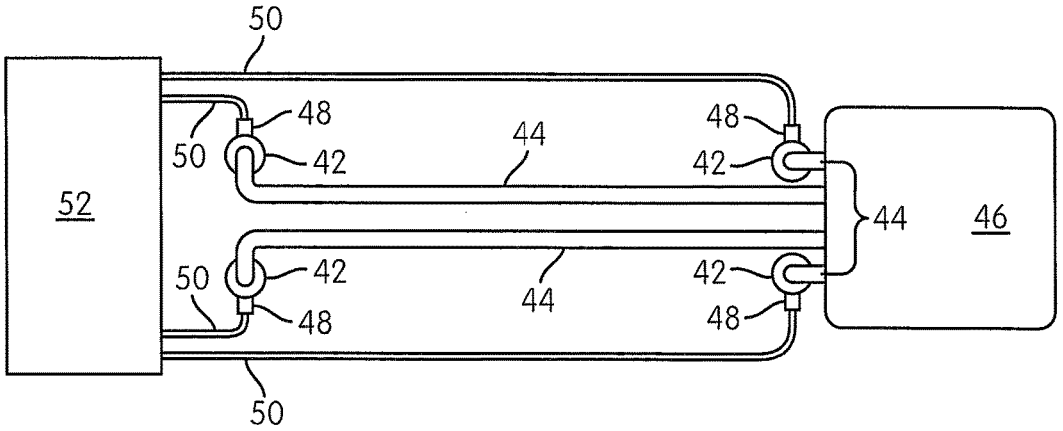
FIG. 4 is a schematic view showing a computer controlled fuel injection system.

FIG. 4 illustrates schematically the four fuel injectors 42 having high pressure fuel lines 44 leading thereto from a conventional source, indicated schematically by the numeral 46. The fuel injectors 42 are constructed and arranged with electrically operated valves shown schematically at 48 which open to inject fuel into the cylinder 14 and close to stop injection. Electrical lines 50 are shown schematically connected to the valves 48. The lines 50 are shown connected to a controller, such as a computer, shown schematically by the numeral 52. The lines 50 transmit signals to the valves 48 to open and close them with the interval between the opening signal and the closing signal determining the amount of fuel injected.

Also, each pair of side by side cylinders 14 are made to communicate with one another by a passage 54 extending between each side by side pair at central portions thereof opposite the injectors 42. The computer 52 is programmed to selectively cause one injector 42 associated with one cylinder of each pair of side by side cylinders 14 to inject zero fuel or in other words not to inject.

The computer 52 normally operates the four injectors 42 to inject the same amount of fuel into both of each same-side pair of cylinders 14L or 14R to cause ignition to occur therein bearing in mind that the injection in the one pair of cylinders 14L or 14R is 180° out of phase with other pair of cylinders 14L or 14R. It will be noted that simultaneous ignition occurs in both cylinders of a pair so that passage 54 is not significantly in play as the high pressure created by ignition in both cylinders 14 will act on both pairs of opposed pistons 18 and 20.

When the computer 52 signals one of the two injectors 42 of each same-side pair of cylinders 14 not to inject, the ignition of the fuel in the other that receives fuel causes high pressure to rise in that cylinder 14, which high pressure is immediately communicated by the passage 54 to the other cylinder 14 at the lower compression pressure so that both pairs of opposed pistons 18 and 20 are moved through power drives strokes together. In effect, the single ignition results in double working expansion of the pressure energy created.

This fuel saving mode of operation which can be selected by the computer 52 reduces the fuel used by the engine in half just as is done with the V-8 that can selectively operate on four cylinders or the dual modular Eco Motor with clutch. The fuel saving mode of the present invention operates all moving components of the engine with a more efficient use of the lesser fueled ignitions.

In order for the computer 52 to select the fuel saving mode in automobile usage, the function of the automobile must be electrically sensed and transmitted to the computer 52. Known sensors exist in automobiles equipped with the V-8 Engine that operates fuel savings with four cylinders. For example, normal operation is selected when the gas pedal movement to accelerate the car is sensed and fuel saving mode is selected when brake pedal movement is sensed. Cruise control when sensed to be on could be used to select fuel saving mode. Sensing motor rotation without wheels turning (idling) would select fuel saving mode.

Referring again more particularly to the drawings there is shown in FIGS. 5-9 thereof a spark ignite internal combustion engine, generally indicated at 110, embodying the principles of the present invention. The engine 110 includes a frame structure, generally indicated at 112, which is shown, in FIG. 5 as being of three piece construction including a main body structure 114 with a head structure 116 on opposite ends of the main body structure 114. It will be understood that the three piece construction is illustrative only and that the frame structure 114 would be actually constructed in many pieces in accordance with known practice.

Figure 5:
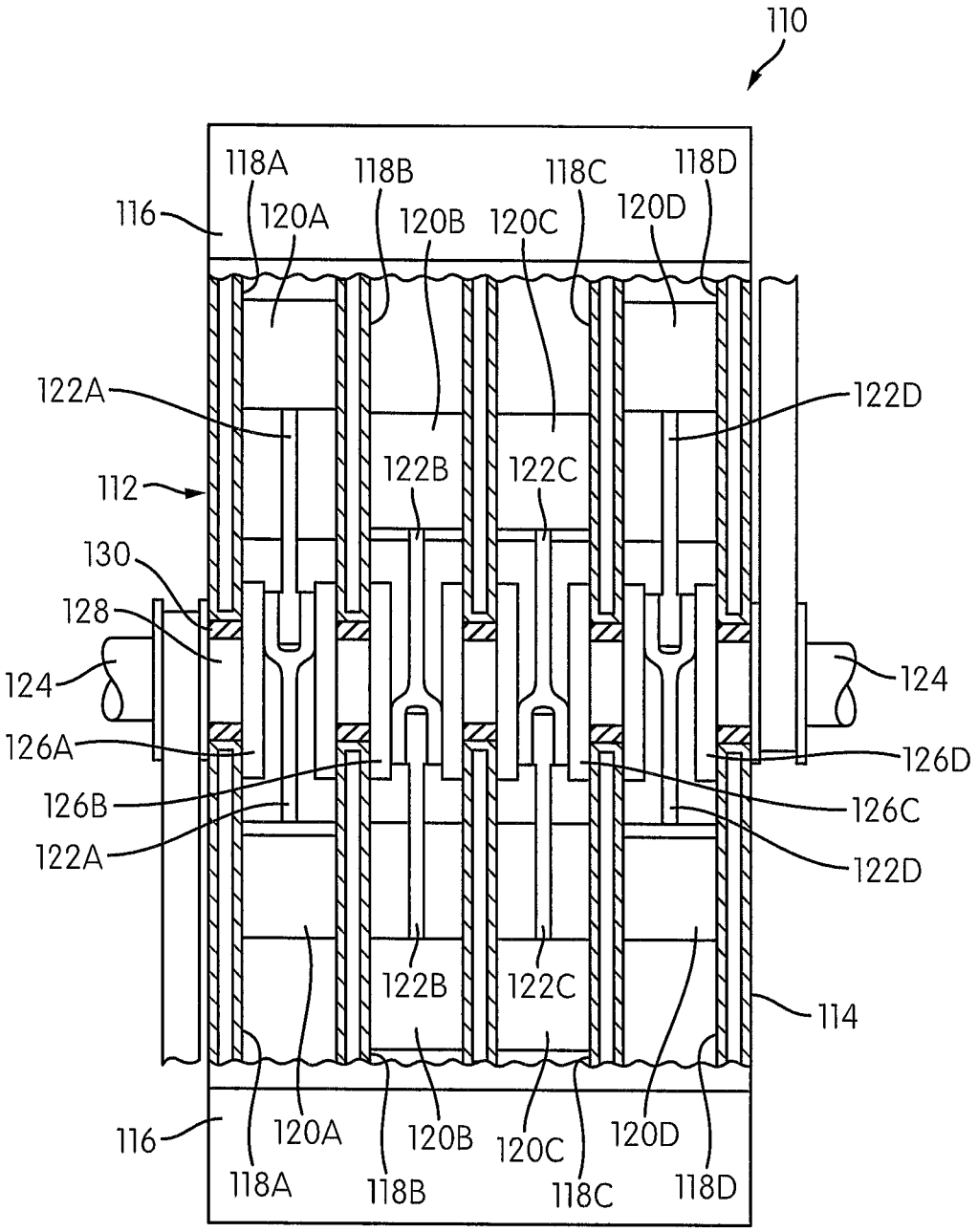
FIG. 5 is a top plan view of another engine embodying the principles of the present invention with parts broken away and shown in horizontal section for purposes of clearer illustration.

As shown in FIG. 5, the engine 110 is opposed piston configuration having opposed duplicate operative piston and cylinder assemblies connected to opposite sides of a centrally located output crankshaft 124 so that the assembles are 180° out of phase with respect to one another.

Since the piston and cylinder assemblies are duplicates of one another, a description of one will suffice to give an understanding of both, keeping in mind that they are 180° out of phase with respect to one another.

Referring now more particularly to the drawings there thereof as best shown in FIGS. 5-8, the body structure 114 includes structures defining four inline cylinders, designated by the numeral 118 with added letters A through D respectively. Slid ably sealingly mounted in the four cylinders 118 are four pistons, designated by the numeral 120 with added letters A through D respectively.

Each piston 120 has one end of a connecting rod 122 pivotally connected thereto as by a conventional wrist pin (not shown). The opposite end of each connecting rod 122 is rotatably connected to the output shaft 124. The output shaft 124 is formed with four U-shaped crank portions, designated by the numeral 126 with added letters A through D respectively, spaced apart by straight bearing portions 128 journalled in bearings suitably mounted on the body structure 114. The crank portions 126A and 126D are oriented to extend outwardly from the adjacent bearing portions 128 in the same directions and the crank portions 126B and 126C are oriented to extend outwardly from the adjacent bearing portions 128 in the same direction but disposed 180° from the direction of extent of the crank portions 128.

Each connection between the ends of the piston rods 122 with the output crank shaft 124 is accomplished by journaling an end of a respective piston rod 122 rotationally on the right of a respective U-shaped crank portion 126. As a result of the orientation of the crank portions 126 and the connection of the piston rods 122 rotatably connected thereto and to the pistons 120 for pivotal movement, the pistons 120A and 122D will move together through simultaneous strokes in one direction while the pistons 120B and 120C move together through simultaneous strokes in an opposite direction.

The head structure 116 which defines an end wall closure for all four cylinders 118 has formed therein an air supply passage designated by the numeral 132 with added letters A through D respectively which communicates with the four cylinders 118 through four inwardly facing valve seat defining inlet openings designated by the numeral 134 with added letters A through D respectively. The head structure 116 also has formed therein four exhaust passages designated by the numeral 136 with added letters A through D respectively which communicate with the four cylinders 118 through four inwardly facing valve seat defining outlet openings, designated by the numeral 138 with added letters A through D respectively.

Mounted on the head structure 116 for movements toward the inlet openings 134 into sealing relation thereto and away from the inlet openings 134 into opening relation thereto are four stem operated poppet valves, designated by the numeral 140 with added letters A through D respectively. Also mounted on the head structure 116 for movements toward the outlet openings 138 into sealing relation thereto and away from the outlet openings 138 into opening relation thereto are four stem operated poppet valves, designated by the numeral 142 with added letters A through D respectively.

The poppet valves 140 and 142 are spring biased to move into sealing relation with their associated openings 134 and 138 by conventional springs 139 and are moved against the spring bias into opening relation to their associated openings 134 and 138 by a camshaft 144 rotatably mounted on the head structure 116 in a position overlying the valves 140 and 142 and the openings 134 and 138. The camshaft 144 is rotationally moved at a rotational speed one half the rotational speed of the output shaft 124 by a conventional rotational movement transmitting mechanism 145 connected between the output shaft 124 and the camshaft 144 so that during every two revolutions of the output shaft 124 the camshaft 144 is driven thereby through one revolution. In this way, the camshaft 144 is able to move the valves 140 and 142 through one cycle of movement while the pistons 120 are moving through a four consecutive 180° strokes of movement.

The sequence of the cycle of movements of the valves 140 and 142 is determined by four inlet opening and closing cam portions, designated by the numeral 146 with added letter A through D respectively.

Formed on the camshaft 144 in axially spaced relation in alignment with and to engage the stem end of the four inlet valves 140 are four outlet opening and closing cam portions, designated by the numeral 148 with added letters A through D respectively. The cam portions 148 are formed on the camshaft 144 in axially spaced relation in alignment with and to engage the stem ends of the four outlet valves 142. Each cam portion 146 and 148 is configured to provide (1) leading surfaces which when engaged with a valve stem moves the valve 142 or 144 in opening relation to the associated opening, (2) a trailing surface which when engaged with a valve stem moves the valve 140 or 142 into sealing relation to the associated opening and (3) a central surface between the leading and trailing surfaces which when engaged with a valve stem holds the valve 140 or 142 in opening relation to the associated opening. The four stroke cycle of movement of each piston 120 controlled by the rotation of the output shaft 124 through two revolutions are as shown in FIGS. 6-9 and indentified in order as an intake stroke, a compression stroke, a power drive stroke, and an exhaust stroke. The coordinated movements of each inlet valve 140 and outlet valve 142 during the four identified piston strokes of the associated piston 120 is as follows (1) during the intake stroke inlet valve 140 is opened and outlet valve 142 is closed (2) during the compression and power drive strokes both valves 140 and 142 are closed and during the exhaust stroke inlet valve 140 is closed and outlet valve 142 is opened. The exact timing of the required valve movement within the associated strokes is in accordance with known practice.

It will be understood that the four supply passages 132 are communicated with a source of filtered air similar to that shown in FIG. 3 and the four exhaust passage 136 are communicated with a muffled exhaust manifold (not shown).

Figure 9:
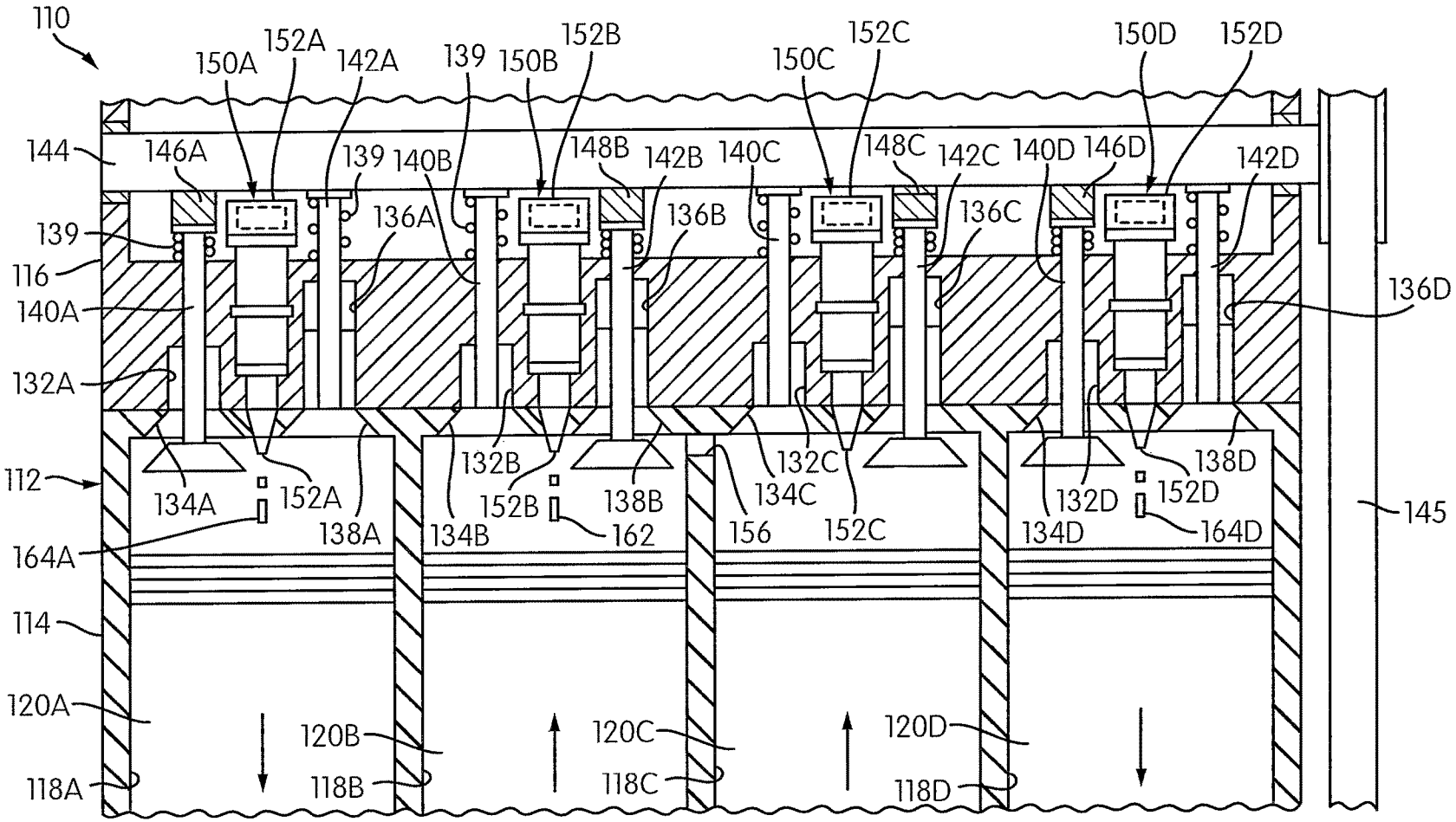
FIG. 9 is a view similar to FIG. 5 showing the position of the parts after another 180° turn of the output shaft from the position shown in FIG. 8.
Figure 9A:
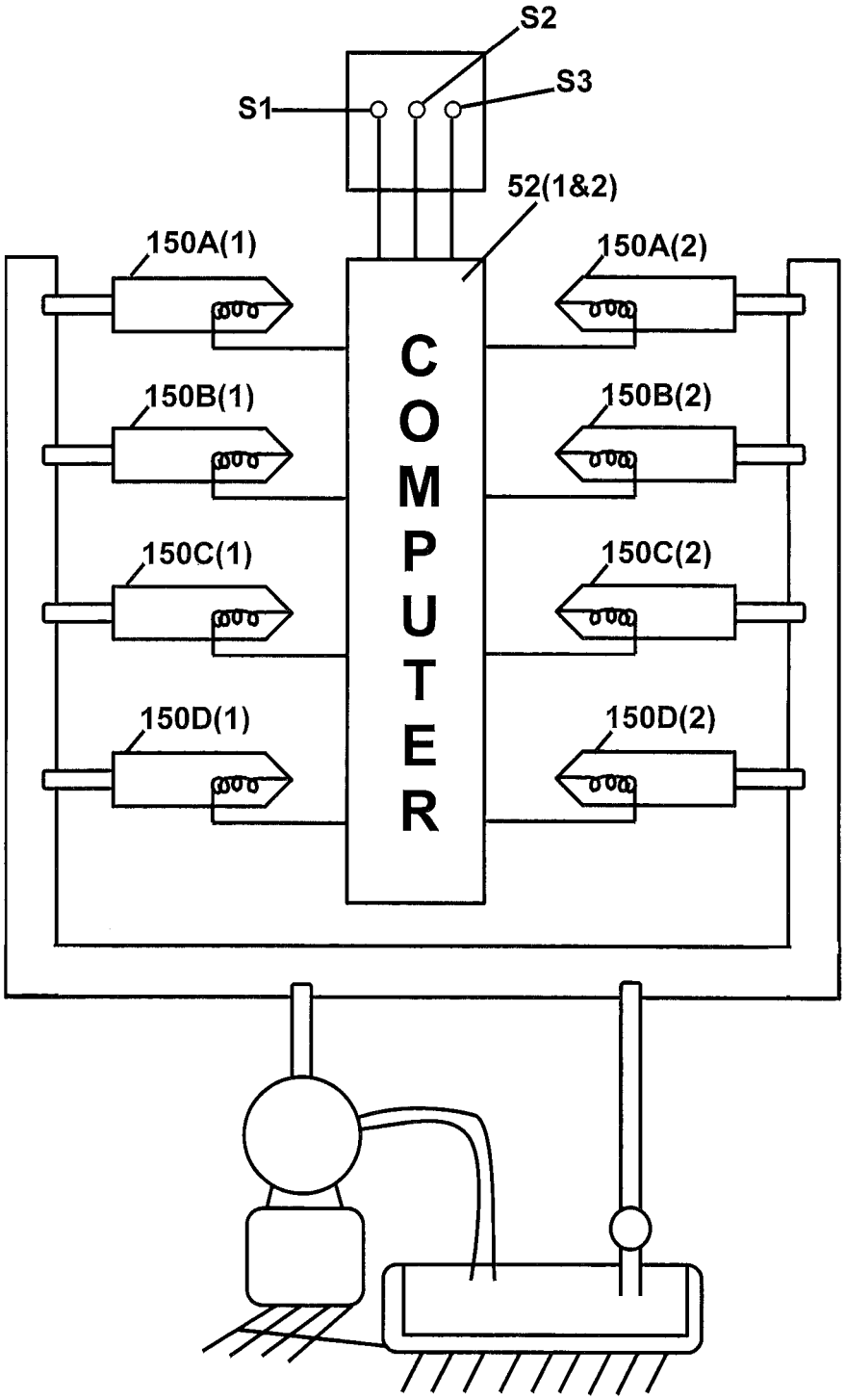
FIG. 9A is a schematic diagrammatic view of a preferred computerized system for controlling the fuel injectors of the engine shown in FIGS. 5-9.

The engine 110 also includes four fuel injectors, designated generally by the numeral 150 with added letters A through D respectively. The four fuel injectors 150 are of known construction and embody a known control system similar to the one shown in FIG. 4 an example, is embodied in a 4 cylinder, four cycle GM engine. Each injector 150 is communicated with a pressurized fuel containing manifold (not shown) through a opening in an upper end 152 thereof. Each upper open end 152 communicates the fuel under pressure received therein to a lower discharge nozzle 154. Each injector 150 also includes an electrically controlled valve similar to the valves between the upper ends 152 of FIG. 4 and lower nozzle 154, which allows fuel under pressure to flow from the nozzle 154, when open, and to prevent the flow of fuel under pressure from the nozzle 154 when closed. The timing between the opening of the control valve and the closing of the control valve determines the amount of fuel injected. The electrically operated control valves are operated by electrical signals from a computerized system as shown in FIG. 9A.

In accordance with the principles of the present invention, the frame structure 116 has a passage 156 formed therein that communicates cylinder 118B to cylinder 118C (the two middle cylinders) adjacent the valve ends thereof.

A conventional distributor —spark plug ignition system is provided for the engine 110, the distributor components of which also not shown, the ignition system includes a spark plug 162 associated with cylinder 118B and spark plugs 164A and 164D associated with cylinders 18A and 18D.

In the normal operation of the engine 110, the pistons 120A and 120D in cylinders 118A and 118D have simultaneous intake strokes during which the injectors 150A and 150B inject the same amount of fuel into the air being drawn into the respective cylinder 118A or 118D. The charges of air fuel mixture within the cylinders 118A and 118D established at the end of the simultaneous intake strokes of pistons 120A and 120D therein are compressed during the following simultaneous compression stroke of the pistons 120A and 120D into compressed charges of mixed fuel and air. When the spark plugs 164A and 164D are simultaneously activated, the pistons 120A and 120D will be moved through their simultaneous power drive strokes, followed by simultaneous exhaust strokes.

In normal operation, the injectors 150B and 150C in cylinders 118B and 118C are also injected with the same amount of fuel as cylinders 118A and 118D. When pistons 120B and 120C establish charges of compressed air and fuel mixture therein at the end of the simultaneous compression strokes thereof, the charges of compressed air and fuel mixture in cylinders 118B is ignited by spark plug 162 and the resulting ignition creates a pressurized flame in cylinder 118B which passes through passage 156 into cylinder 118C to ignite the charge of compressed air and fuel mixture in cylinder 118C.

In accordance with the principles of the present invention, during the fuel saving cycle of a fuel saving mode, the injector 150C associated the cylinder 118C does not go through an injection cycle but injector 150B does. Thus, when the pistons 120B and 120C reach the end of their simultaneous compression strokes, cylinder 118B will have established therein a charge of compressed air and fuel mixture while cylinder 118C will have established therein a charge of compressed air.

When the charge of compressed air and fuel mixture in cylinder 118B is ignited by spark plug 164B, the high pressure conditions created as a result thereof are immediately communicated by means of passage 156 with the charge of compressed air in cylinder 118C to raise the pressure acting on pistons 120C during the simultaneous power drive stroke thereof with piston 120B.

Since the pistons 120A and 120D together are 180° out of phase with the pistons 120B and 120C together. The simultaneous power drive strokes of both pairs will fall within one rotation of the output shaft 124. It will be remembered that the opposite duplicate bank is also 180° out of phase with the first bank so that the simultaneous power drive strokes of both duplicate pairs in the duplicate bank will occur within the other full rotation of the out put shaft 124 in each two rotational cycle. Thus, a pair of simultaneous power drive strokes will be applied to the shaft 124 during each half revolution thereof. In normal mode operation all of the power drive strokes will be of the same force. During the fuel saving mode of operation, the outer pair of pistons in each bank have equal power drive strokes equal to those of normal operation. However, the power drive stroke of the inner pair of each bank are powered by one half the fuel and go through twice the expansion.

It should be noted that with spark ignition in normal mode operation, the time delay between the ignition in the first cylinder and the time the ignition of the first takes to ignite the second could move peak pressures in the second nearer the most efficient crank angle.

It is also within the contemplation of the present invention to provide either a one bank or two bank internal combustion engine which operates at all items within the gas saving cycle of the present invention.

Referring now more particularly to FIG. 9A there is shown therein a preferred embodiment of a computerized system for controlling the injectors 150 A-D associated with each bank of four piston and cylinder assemblies. To distinguish between the two banks, the injectors of bank 1 have the designation (1) added and the injectors of bank 2 have the designation (2) added.

The system includes a computer 52 (1 & 2) which receives electrical signals from a switch panel having three switches S(1), S(2), and S(3). The three switches as shown are manually actuatable but it would be possible to actuate them in response to sensed conditions such as the vehicle going onto an upgrade, or the cruise control being activated and the like.

With the three button panel as shown, when switch S(1) is activated, the computer 52 (1 & 2) is programmed to operate all of the injectors 150 A-D (1 & 2) in properly timed relation. When all injectors are injecting fuels the engine 110 is operating at full power mode useful when the vehicle is on an upgrade or any time a burst of power is needed. It is noted that when in this mode, a double firming will occur during each stroke or 180° turn of the output shaft.

When switch S(2) is activated, the computer is programmed to inject fuel alternately to injectors 150 B(1) and 150 C(1) and alternatively to injectors 150 B(2) and 150 C(2) all in properly timed relation. Injectors 150 A (1 & 2) and 150 D (1 & 2) are allowed to inject fuel in normally timed relation to their respective cylinders. Depending upon whether the new crankshaft is configured to allow the two remaining cylinders of each bank to operate 180° out of phase with respect to one another or in phase with respect to another, the delivery of fuel by the respective injectors 150 A (1 & 2) and 150 D (1& 2) will result in two double firmings out of phase with respect to one another and with respect to the firming of injectors 150 B (1 &2) and 150 C (1 & 2). In this mode of operation two fuel injector jets of fuel are simply not injected during each cycle and yet all assemblies involved have a power stroke. On this basis, there are still two power strokes per 180° turn of the crankshaft with a saving of one quarter of the amount of fuel injected as compared with the full power mode. This mode is useful except when the full power mode is chosen or except when a full fuel saving mode is chosen by activating button S(3). When switch button S(3) is activated the computer 52 (1 and 2) is programmed to alternately activate either injectors 150 A(1) and 150 A(2) and injectors 150 D(1) and 150 D(2) or to alternately activate either injectors 150 A(1) and 150 D(1) and injectors 150 A(2) and 150 D(2) depending upon the configuration of the new crankshaft. In this full fuel saving mode two of the remaining four assemblies simply are not fed a supply of fuel with the pistons of the no fuel assemblies moving through their cycles. This "skipped" injection arrangement is well known per se. It is noted that the skipped cylinders are those that previously had entered into double firing either fully as in the full power mode or in conjunction with the fuel cutting of cylinders 150 B and 150 C. The result is an actual single injection and firing every stroke or 180° turn of the crankshaft even though the single injections with respect to the injectors 150 B and C results in double firings.

Figure 10:
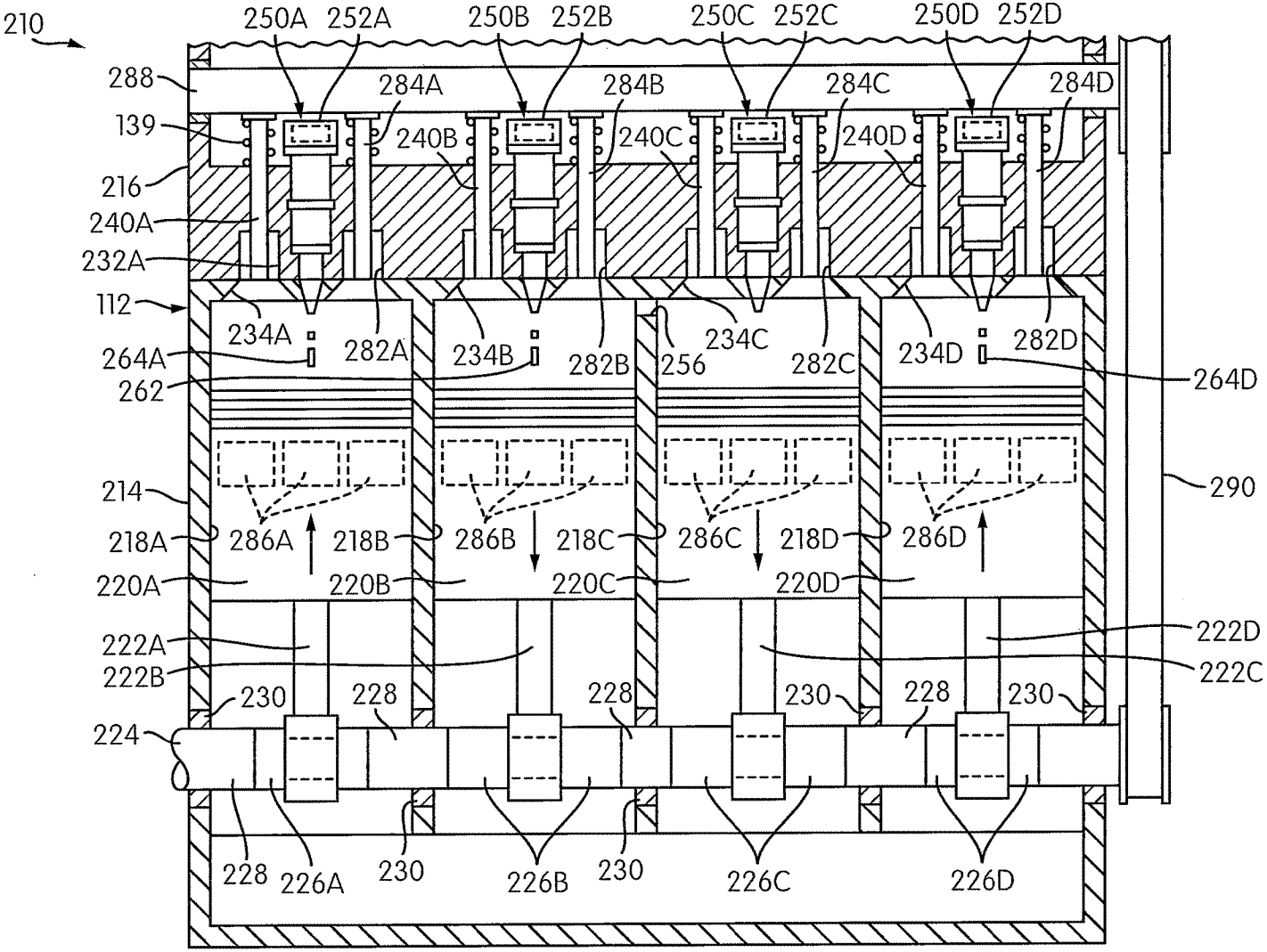
FIG. 10 is a horizontal sectional view of a spark ignited engine embodying the principles of the present invention which operates on a two stroke cycle.

Referring now to FIG. 10 there is shown therein an engine 210 embodying the principles of the present invention which operates on a two stroke cycle rather than on a four stroke cycle. As shown similar parts have been given numbers with a leading 2 rather than the leading 1 as in FIGS. 5-9 so that the description will be concerned only with the differences.

First, the exhaust outlets 136 are changed to inlets designed by the numeral 282 with added letters A through D respectively. Thus outlet valves 142 A-D become inlet valves 254A-D that are moved simultaneously with the inlet valves 240 A-D respectively.

Second, the cylinders 220 are formed with a series of annularly spaced outlets, designated by the numeral 286 with added letters A through D respectively, as before, the inlets 232 and 282 communicate with a filtered air manifold (source not shown) and the outlets 286 communicate with a muffled exhaust manifold not shown.

The four piston and cylinder assemblies of the engine 210 are provided with a different cam shaft 288 for controlling each assembly to go through a two stroke cycle of movement during each revolution of output shaft 224. The rotational motion transmission assembly 145 is changed to effect this change as indicated at 290 so that the rotation of the cam shaft 288 is driven through one revolution during each rotation of the output shaft 224. Each cycle includes a gaseous charge exchange portion which establishes that each piston has an appropriate charge of compressed gas therein either an air-fuel mixture or air without fuel mixed therein at the end of a first compression stroke. The charges of compressed air-fuel mixture are then ignited to begin a return power drive stroke at the end of which the gaseous charge exchange portion begins when the associated piston 220 moves below the outlets 286 and inlet valves 243 and 284 are opened. The gaseous charge exchange portion ends with the movement of the piston 220 upwardly beyond the outlets 286 after which the rest of the stroke is compression.

The crank shaft 224 is the same as far as piston movements are concerned. The piston 220B and 220C move together while pistons 220A and 220D move together. With the cycle the same and thereof 180° out of phase with respect to simultaneous cycles of pistons 220B and 220C.

FIG. 10 shows the position of the parts with the pistons at respective mid positions of movement corresponding to the middle of the power drive strokes of pistons 220B and 220C and the middle of the compressing strokes of piston 220A and 220D, with all valves closed. When the engine 210 with spark ignition is in a fuel saving mode, the two middle piston and cylinder assemblies B and C go through a gas exchange portion together but only cylinder 218B receives a fuel charge during gas exchange so that at the end of the compression stroke cylinder 218B has a charge of compressed air-fuel mixture therein while cylinder 218C has a charge of compressed air therein. As before the ignition of the charge in cylinder 218B is communicated through passage 256 to raise the air compression pressure in cylinder 218C and effect the power drive stroke thereof together with the drive stroke of piston 220B.

The same cycle is carried out in cylinders 220A and 220D only 180° out of phase with respect to one another. The operation in normal mode operation is that both cylinders receive a charge of air-fuel mixture which are both ignited as before. The engine 210 has the advantage that a double power drive stroke is applied every half turn of the output shaft 224. The fuel saving mode achieves the advantage previously noted.

Figure 11:
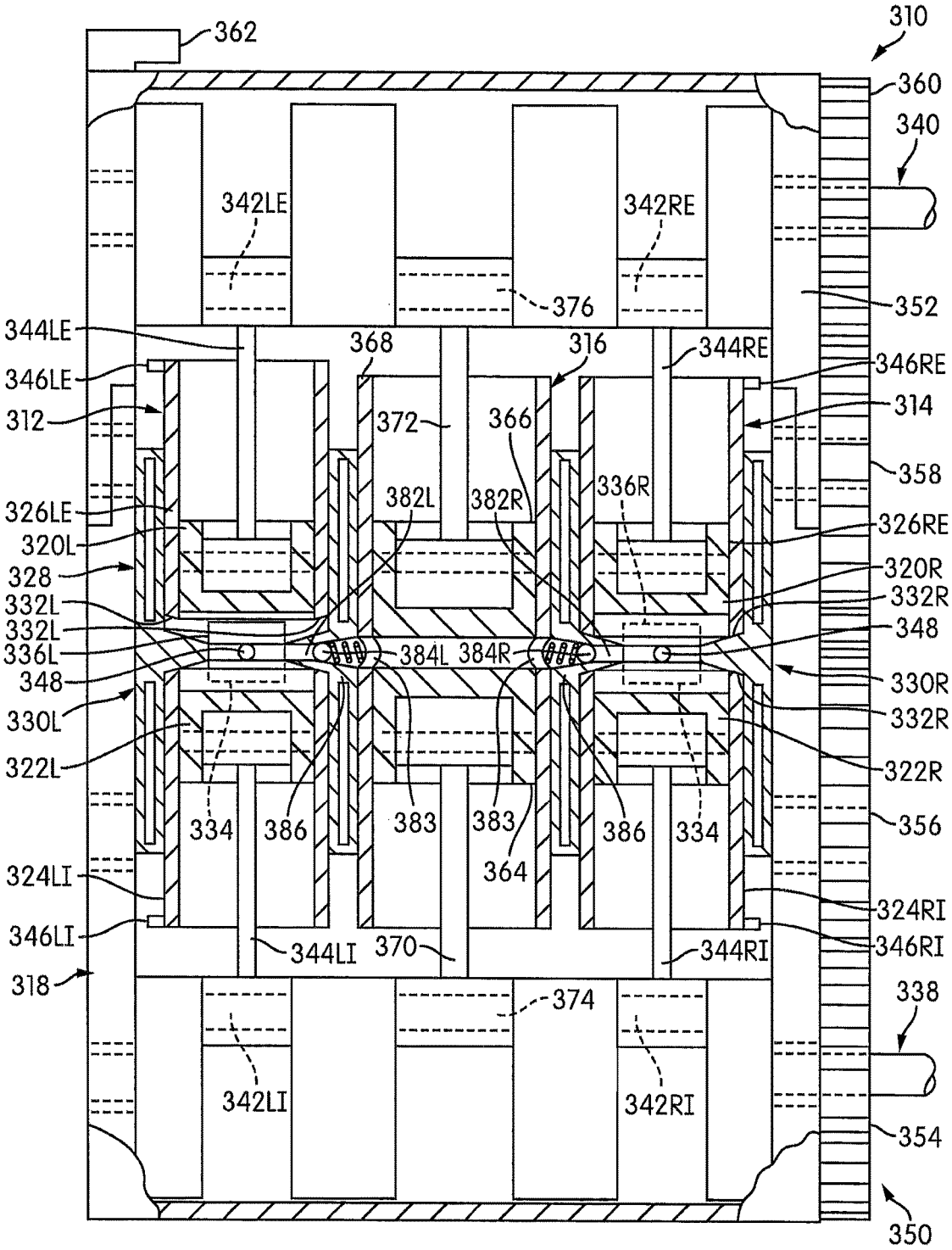
FIG. 11 is a top plan view of an internal combustion engine embodying the principles of the present invention showing the three opposed crankshaft driven opposed pistons and cylinder assemblies of the engine in horizontal section arranged with a two stroke assembly between two four stroke assemblies with the opposed pistons of the three assemblies two 4 stroke assemblies in minimum spaced apart combustion chamber defining limiting positions.
Figure 12:
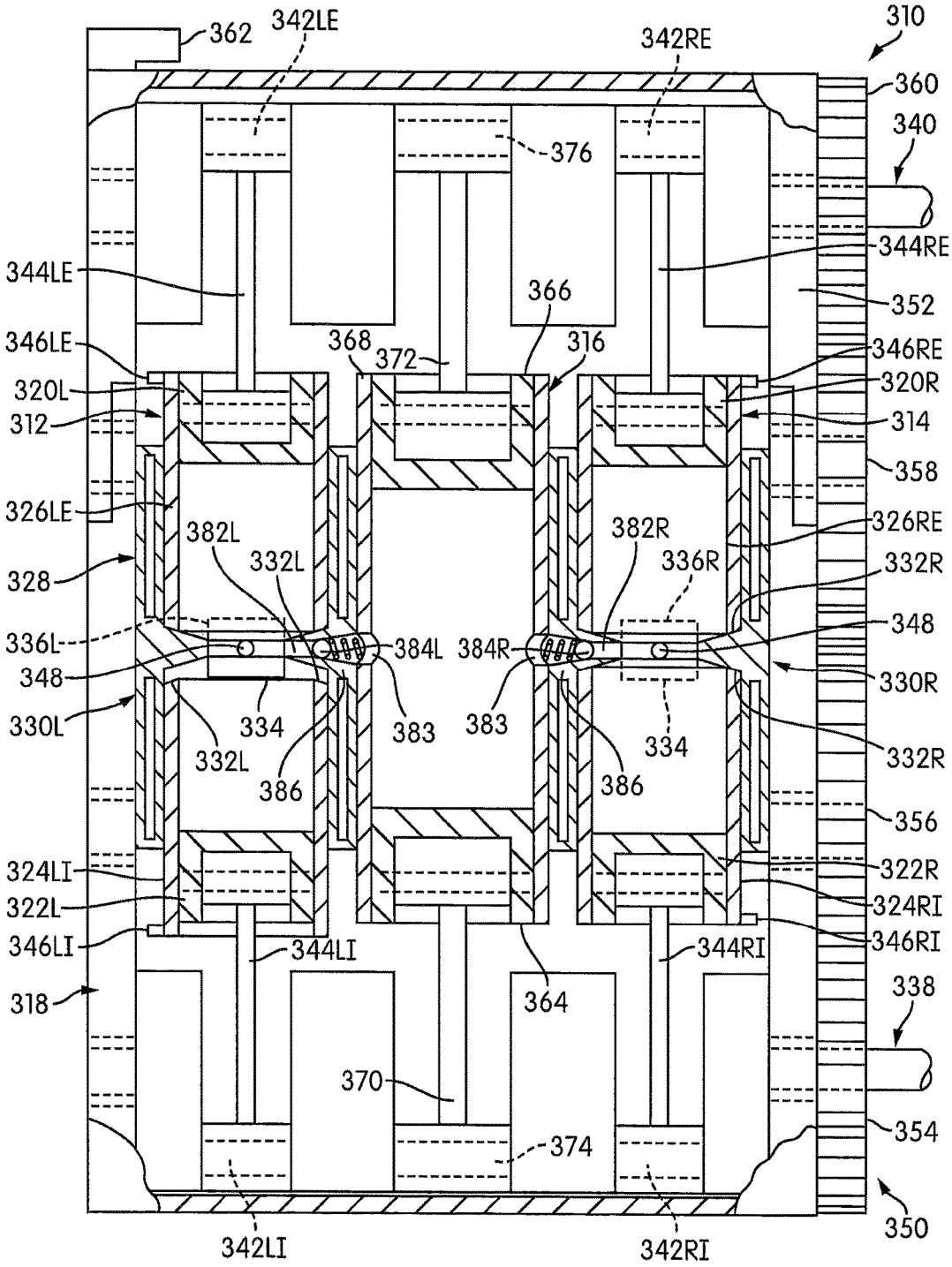
FIG. 12 is a view similar to FIG. 11 wherein the opposed pistons are disposed in a maximum spaced apart limiting position.

Referring now more particularly to Pinnacle type embodiment, there is shown in FIGS. 11 and 12 an internal combustion engine partially in horizontal section which embodies the principles of the present invention. The engine is designated generally by the reference numeral 310. Basically, the engine 310 includes Pinnacle engine components including first and second opposed piston and cylinder assemblies 312 and 314 and an added third opposed piston and cylinder assembly 316 disposed between the first and second assemblies 312 and 314.

The first and second opposed piston and cylinder assemblies 312 and 314 may be constructed in accordance with the aforesaid patent disclosures owned by Pinnacle. As such, each assembly 312 and 314 is carried by a frame assembly 318 and includes a pair of opposed pistons 320 and 322 and a further letter designation R or L depending on which is shown at the right (R) or left (L) in FIG. 11. Each piston 320 or 322 includes a further letter designation I for Inlet or E for Exhaust. The pistons 320 are slidably mounted in a cylinder section designated by the numeral 324 with a further similar letter designation and the pistons 322 are slidably mounted in a cylinder section designated by the numeral 326 with a further similar letter designation.

Cylinder sections 324 and 326 constitute valve elements which are each mounted in a fixed main frame section 328 of the frame assembly 318 for cooperating reciprocating movement with respect to a swirl control valve structure, generally indicated at 330. Each swirl control structure 330 is disposed between the associated cylinder sections 324 and 326 and extends outwardly therefrom in fixed relation to the main frame section 328.

Each swirl control valve structure 330R or 330L has interior surfaces which provide valve seats and define the exterior of a centrally located combustion chamber 332R or 332L which communicates with the interior of the associated cylinder sections 324R and 326R or 324L and 326L. Each swirl control valve structure 330R or 330L also provides an inlet 334R or 334L which leads to the combustion chamber 332R or 332L and is opened thereto or closed there from by the position of reciprocating movement of the associated cylinder section 324RI or 324LI and an outlet 336R or 336L which leads from the combustion chamber 332R or 332L and is opened there to or closed there from by the position of reciprocating movement of the associated cylinder section 326RE or 326LE.

In accordance with the teachings of the aforesaid Pinnacle Pat Appln Pubs, each swirl control valve structure 330 also includes air and fuel supply valving (not shown in the drawings) capable of establishing an air-fuel mixture of a controlled fuel richness or leanness in a swirl formation to the combustion chamber 332R or 332L in timed relation to the cyclical movement of the pistons 320 and 322 within their respective cylinder section 324 and 326. The pistons 320 and 322 are cyclically moved within their respective cylinder sections 324 and 326 by means of opposed crankshafts 338 and 340, each having a pair of axially spaced similarly radially directed crank portions 342. One end of a connecting rod 344 is pivoted to each crank portion 342 the opposite end of which is pivoted to an associated piston 320 or 322.

The opposed crankshaft and connecting rod arrangement has the effect of moving the pistons 320 and 322 within their respective cylinder sections 324 and 326 toward and away from each other and toward and away from the associated centrally located combustion chamber 332.

The timing of the cyclical movements of the pistons 320 and 322 is related to the reciprocating movements of the cylindrical sections 324 and 326 by a camshaft assembly (not shown) suitably driven by the crankshaft rotation and constructed in accordance with the aforesaid Pinnacle Pat. Appln. Pubs. The components which transmit the rotational movement of the camshaft assembly to the reciprocating movements of the cylinder sections are not shown in the drawings except for a flange portion 346 on the exterior of each cylinder section 324 and 326 by which each cylinder section 324 and 326 is reciprocatingly moved.

The timing establishes a conventional four stroke cycle for each assembly 312 and 314 which are essentially 180° out of phase with respect to one another. Each four stroke cycle includes the usual intake stroke where the pistons 320 and 322 move apart to take into the cylinder volume between the pistons 320 and 322 a charge of air fuel mixture provided by the associated swirl control valve structure 332 with a cylinder section 324 opening an inlet 334. After the pistons 320 and 322 reach a limiting position apart, the inlet is closed by movement of the cylinder section 324 and they begin a movement toward one another through a compression stroke into a limiting position in closely spaced relation to one another wherein the air-fuel mixture is compressed within the combustion chamber 332 to a compression pressure. In appropriately timed relation toward the end of the compression stroke, a spark plug 348, provided by the associated swirl control valve structure 330, is energized to ignite the air fuel mixture. The increased pressure conditions of the ignition drive the pistons 320 and 322 away from each other through a power stroke. The cycle is completed by a movement of the pistons 320 and 322 toward each other through an exhaust stroke during which the associated cylinder section 326 opens the outlet 336 provided by the swirl control valve structure 330. Each stroke of the cycle is accomplished during one half of one revolution of the crankshafts 338 and 340, with each cycle taking place in two revolutions of the crankshafts 338 and 340. The four consequative events that take place in four consequative strokes are accomplished by the camshaft assembly which is geared to rotate at half the rotational speed of the crankshaft 338 or 340.

In accordance with the disclosure of the cited Pinnacle Pat. Appln. Pubs., the assemblies 312 and 314 are constructed so that the compression ratio of each can be varied, which varies the compression pressure in the combustion chamber 332 at the end of each compression stroke of the assembly 312 or 314. This variation is accomplished by connecting the crankshafts 338 and 340 rotationally together by a gear train 350 and mounting the crankshaft 340 on a frame assembly subframe 352 pivotally mounted on the main frame assembly 318.

Figure 13:
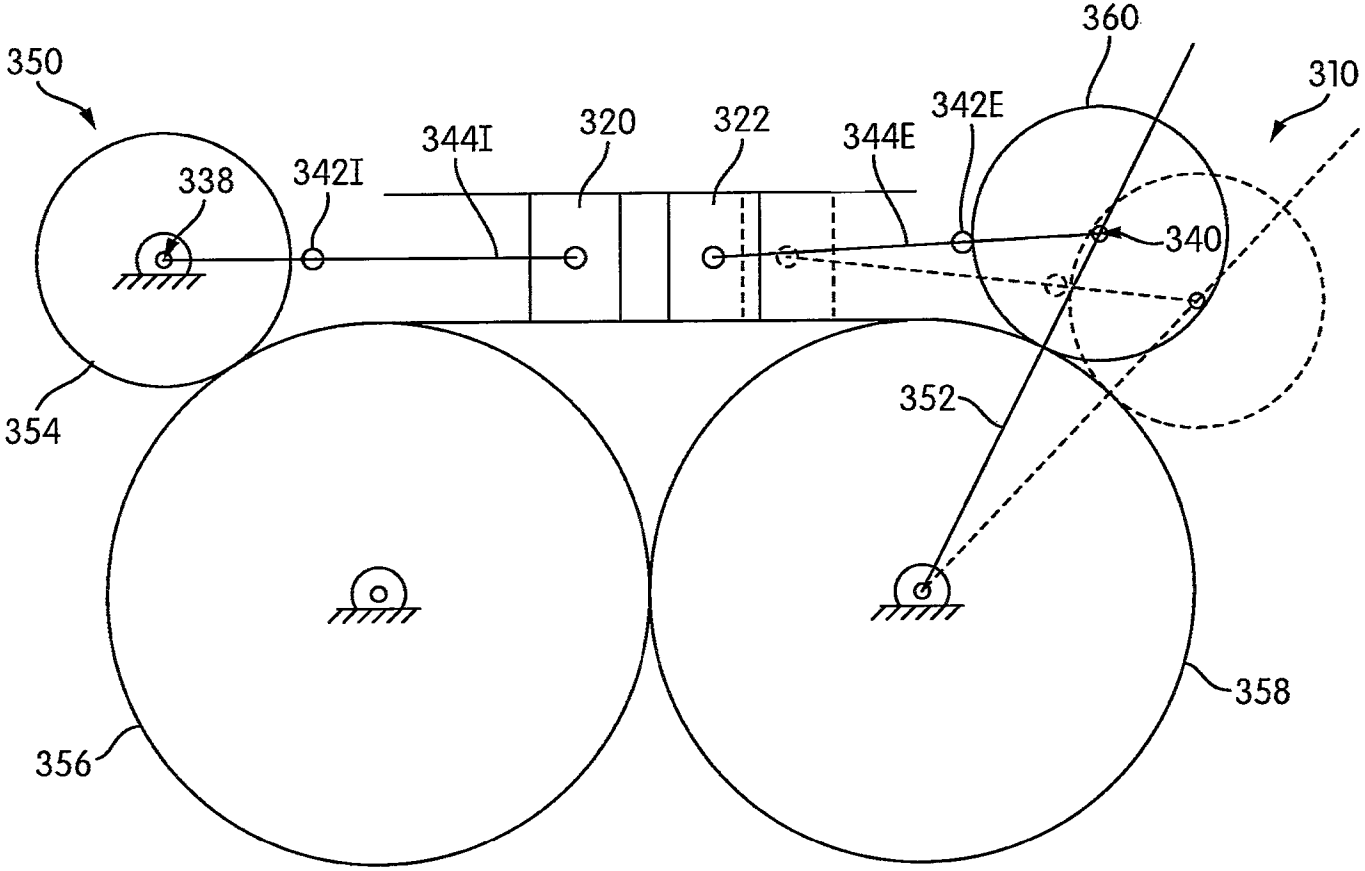
FIG. 13 is a diagrammatical view showing the components of the engine shown in FIGS. 11 and 12 which enable the combustion ratio of the two four stroke assemblies to be varied.

Referring now more particularly to FIG. 13, the gear train 350 includes a first gear 354 fixed to the crankshaft 338 which, in turn, is journaled on the main frame assembly 318 for rotation about a fixed axis of rotation. The first gear 354 meshes with a second gear 356 suitably journaled on the main frame assembly 318 for rotational movement about a fixed axis. The second gear 355 is preferably double the size of first gear 354 and meshes with it and with a third gear 358 of the gear train 346 of the same size. Third gear 358 is suitably journaled on the main framed assembly 318 for rotational movement about a fixed axis of rotation.

The gear train 350 includes a fourth and final gear 360 which meshes with third gear 358 and is fixed to the crankshaft 340. The crankshaft 340 is mounted on the subframe 352 of the main frame assembly 318 which is pivotally mounted for pivotal movement about the rotational axis of movement of the third gear 358. When the subframe 352 is moved about its pivotally axis by an activator 362, shown in block diagram in FIG. 14, the compression ratio of the first and second opposed piston and cylinder assemblies 312 and 314 can be varied.

As best shown in FIGS. 11 and 12, the third opposed piston and cylinder assembly 316 includes a pair of opposed pistons 364 and 366 mounted for movement toward and away from each other within a cylinder 368 fixedly mounted on the frame section 328 between the spaced assemblies 312 and 314. The pistons 364 and 336 are moved by the crankshafts 338 and 340 respectively by means of connecting rods 370 and 372 each having one end pivoted to the associated piston 364 or 366 and an opposite end to a central crank portion 372 or 376 on the respective crankshaft 338 or 340.

The cylinder 368 has spaced inlet and outlet openings 378 and 380 (FIG. 14) formed in the wall thereof which are valved by the passage of the pistons 364 and 366 there over. When the inlet opening 378 is connected with a source of air-fuel mixture, as shown in FIG. 14, the third assembly can operate as a two stroke engine.

As best shown in FIGS. 11 and 12, in accordance with the principles of the present invention, the combustion chamber 332 of each assembly 312 and 314 is communicated with central piston defined combustion chamber of the assembly 316. As shown the communication is accomplished by passages 382 R and 382 L extending from each combustion chamber 332, through the associated swirl valve control structure 330 to the center of cylinder 332 by means of an opening 383 therein. Each passage 382 R or 382L is provided with a check valve 384R or 384L respectively which allow gas pressure to flow from the assemblies 312 and 314 to the assembly 316 while preventing gas flow in the opposite direction.

Figure 14:
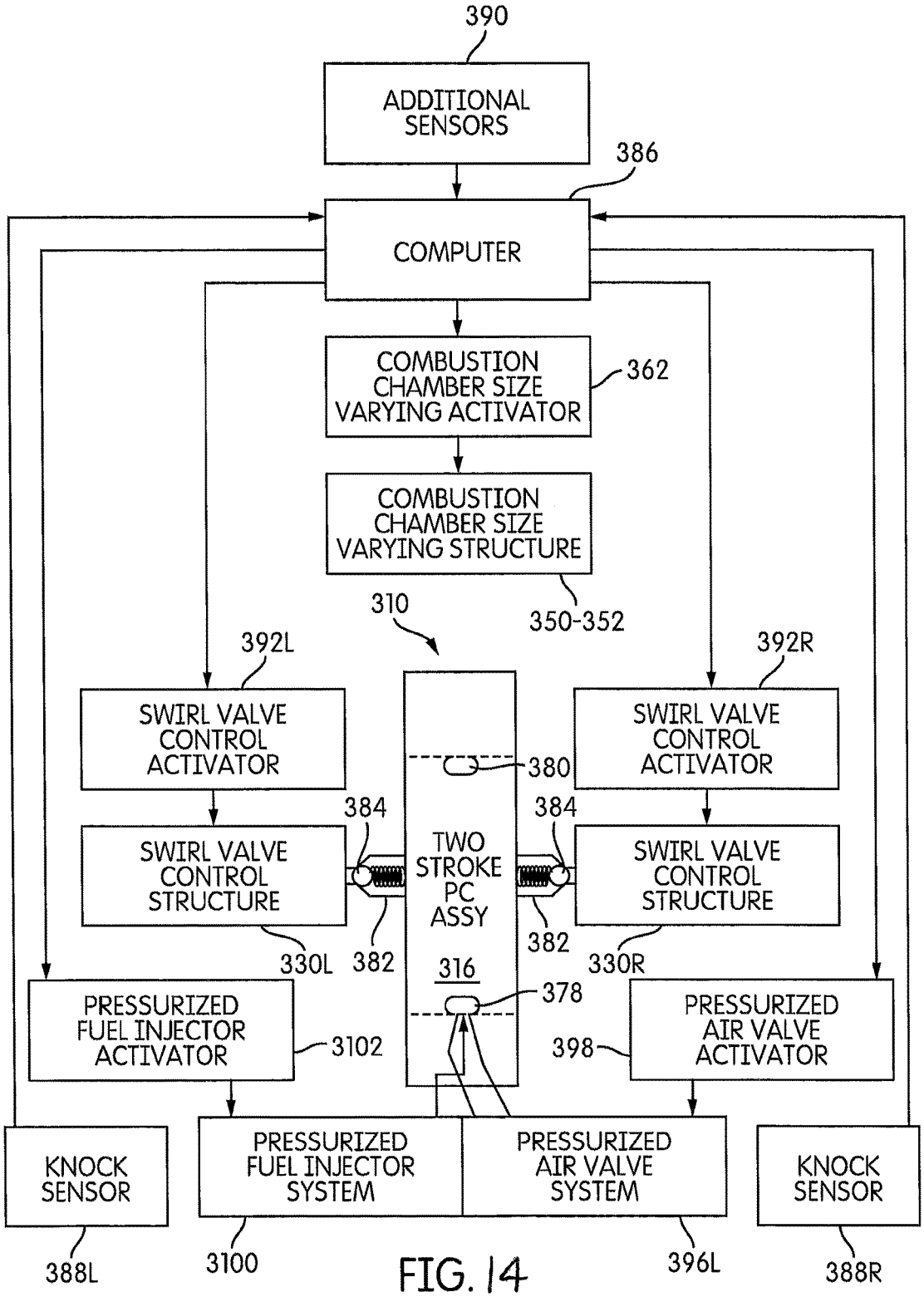
FIG. 14 is a block diagram view of a computer controlled operating system forming a part of the engine shown in FIGS. 11 and 12 when embodied in an automotive vehicle as a drive motor for the vehicle.

Referring now more particularly to FIG. 14, there is shown therein a block diagram of a computer controlled system for an automobile driven by the engine 310. The system includes a computer 386 powered by the car battery (not shown). The computer 386 receives signals sensed by a knock sensor 388 for each assembly 312 and 314. The computer 386 also receives signals from other sensors indicated by block diagram 390. Such sensors may include ignition key on and off, output shaft rotational speed, wheel rotational speed, gas and brake pedal movements and the like.

In accordance with the teaching of the aforesaid Pinnacle Pat. Appln. Pubs., the system includes a combustion chamber size-varying activator 392 under the control of computer 386 which controls the movement of the combustion size varying structure 350-352 and a swirl valve control activator 394 which controls the swirl valve control structure 330. These components function in the dual manner disclosed in the cited Pinnacle Pat. Appln. Pubs. Specifically, US 2011/0220058 discloses two modes of operation. The first mode is a power mode for medium to high loads and the second is an efficiency mode for low to medium loads. The activators 392 and 394 control the combustion size varying structure 350-352 and the swirl valve control structures 330 to feed a lean air-fuel mixture under low compression in the efficiency mode, which mixture is made richer under high compression pressures for more power in the power mode. These pinnacle components of the system can also use ignition timing to allow the first and second modes to be at the same air-fuel mixture.

The components of the system which are added in accordance with the principles of the present invention include a pressurized air assembly valve 396 with its activator 398 and a pressurized fuel injector 3100 with its activator 3102. These components operate in known conventional fashion to normally deliver a variably determined amount of mixed air and fuel to the inlet opening 378 of the assembly 316 at the start of the inlet stroke of the pistons 364 and 366.

Since the air-fuel mixture initially delivered to assembly 316 is at a pressure greater than the pressure of the air fuel mixture initially delivered to the assemblies 312 and 314, gas pressure flow passed the check valves 384 from the combustion chambers of the assemblies 312 and 314 to the combustion chamber of the assembly 316 will not occur until firing occurs in the assemblies 312 and 314 and no firing occurs in the combustion chamber of the assembly 316.

The no firing condition within the assembly 316 is accomplished by the activator 3102 of the pressurized fuel injector 3100. The present invention contemplates operating in either one of two computer controls of the activator 3102. The first is that the injector 3100 is activated to supply fuel when the Pinnacle components are in the second mode and to cut off the supply of fuel from the injector 3100 when the Pinnacle components are in the first mode. The second is that the injector 3100 is activated to cut off the supply of fuel during both the first and second modes of the Pinnacle components and is activated to supply fuel only in response to a different signal such as an uphill sensing switch actuation or a switch actuation in response to a floor boarding of the gas pedal.

In the first instance there will be no firing in the combustion chamber of the assembly 316 when the Pinnacle components are operating in the first mode, however, because the four stroke cycles of assemblies 312 and 314 are 180° out of phase with respect to one another, one of the assemblies 312 or 314 is fired simultaneously to each firing stroke of the assembly 316 and the increased pressure conditions resulting from the alternate firings in assemblies 312 and 314 will be communicated through passages 382 passed check valves 384 to the combustion chamber of the assembly 316 to add to the air compression pressure therein and drive the pistons through their power strokes simultaneously with the corresponding drive stroke of the assembly 312 or 314.

In the first instance when the Pinnacle components are operating in the second mode, the combustion chamber of the assembly 316 will contain a compressed air-fuel charge simultaneous with one of the assemblies 312 and 314. The firing of the air-fuel charge in the combustion chamber of the assembly 312 or 314 is utilized to ignite the air-fuel charge in the assembly 316 by fire passing through the associated passage 382 beyond the associated check valve 384.

In the second instance, when the Pinnacle components are in either first or second mode, the assembly 316 with cut off fuel operates to provide added working expansion for the alternate firing of the assemblies 312 and 314. When fuel is fed to the assembly 316 its power strokes are simply added to the alternate power strokes of the assemblies 312 and 314.

The first instance has the advantage that the first mode of the Pinnacle components is made more efficient while the second mode is made more powerful. The second instance has the advantage that both the first and second modes of the Pinnacle components are made more efficient and power can be added only when needed.

When the two stroke assembly 316 is operating with fuel it will be fired once each revolution of the crankshafts, whereas the two four stroke assemblies 312 and 314 provide one firing each revolution between them. The result is that at maximum power in the power mode there will be four jets of fuel during a cycle of two revolutions of the crankshafts 338 and 340 and at maximum efficiency in the fuel saving mode half of the fuel injected at maximum power is saved by never being injected. Moreover, it is to be noted, that even when the fuel is cut off, all of the components of the engine 310 are operating and functioning to achieve the efficiency or power boost results.

It is within the contemplation of the present invention to provide an added third assembly 316 which is never fired and simply functions as an efficiency booster for the other two assemblies 312 and 314.

It is noted that in either of the two instances described above, the firing during four consequative strokes will be 2 fires, no fires, 2 fires, no fires. Thus while balanced, there is lacking the usual completely balanced firing of one fire per stroke.

The engine 310 can be made to fire completely balanced by two fires each stroke by adding three more piston and cylinder assemblies. When added, the three new piston and cylinder assemblies are operated 180° out of phase with respect to the first three piston and cylinder assemblies.

Figure 15:
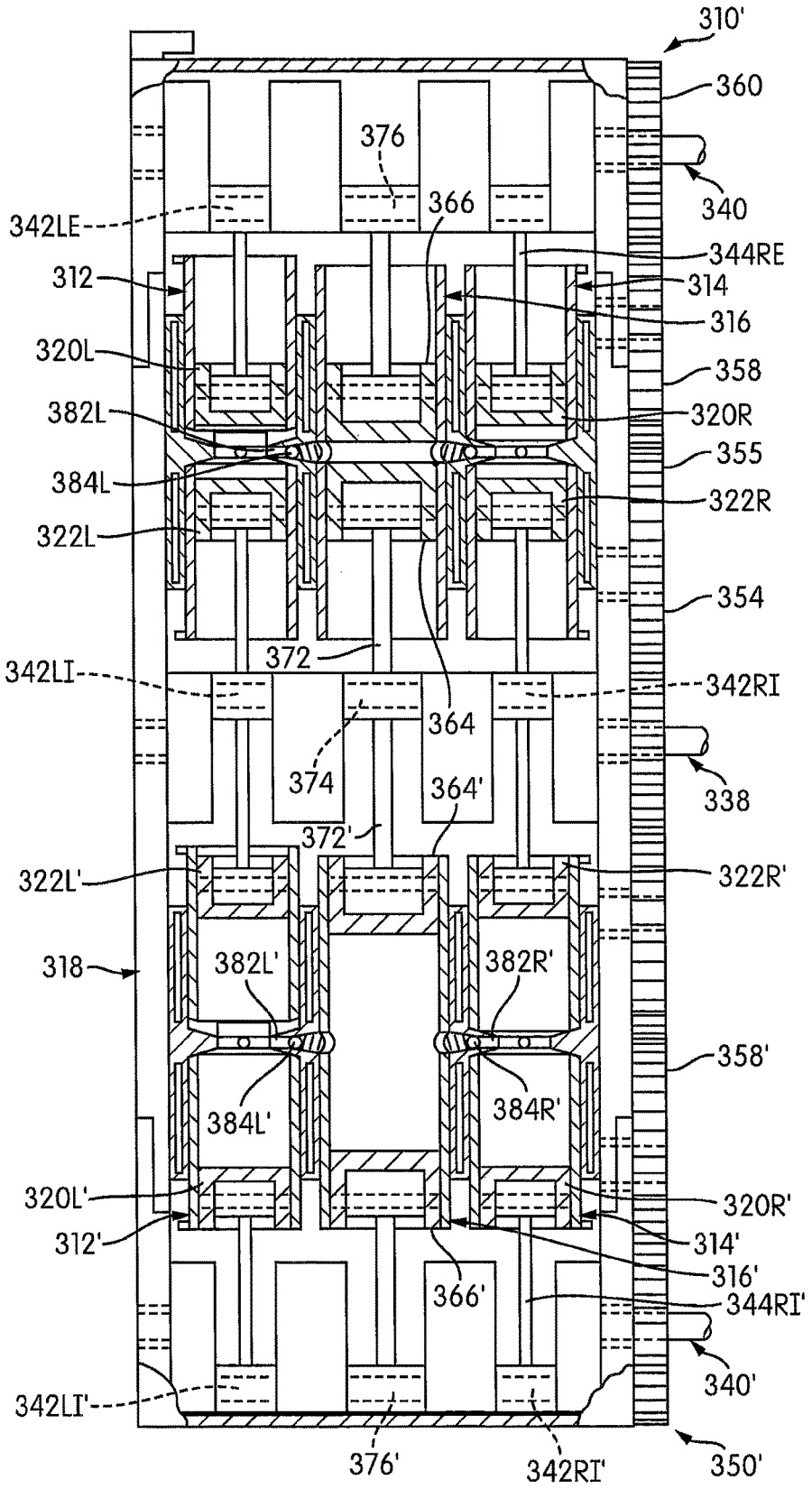
FIG. 15 is a schematic line diagram view of one modification of the internal combustion engine shown in FIG. 11.

FIG. 15 schematically illustrates a modified engine 310$^1$ wherein like added parts are designated by the same reference characters with an added 1 (prime). As shown in FIG. 15, when the three new added assemblies 312$^1$, 314$^1$ and 316$^1$ are placed in opposed relation to the original three assemblies 312, 314 and 316 the added three assemblies 312$^1$, 314$^1$ and 316$^1$ are automatically made to move 180° out of phase with the original assemblies 312, 314 and 316, this movement by virtue of having one set of pistons 322$^1$ and 364$^1$ being moved by the crankshaft 338 which moves one set of pistons 322 and 364 of the original three assemblies 312, 314, 316.

Figure 6:
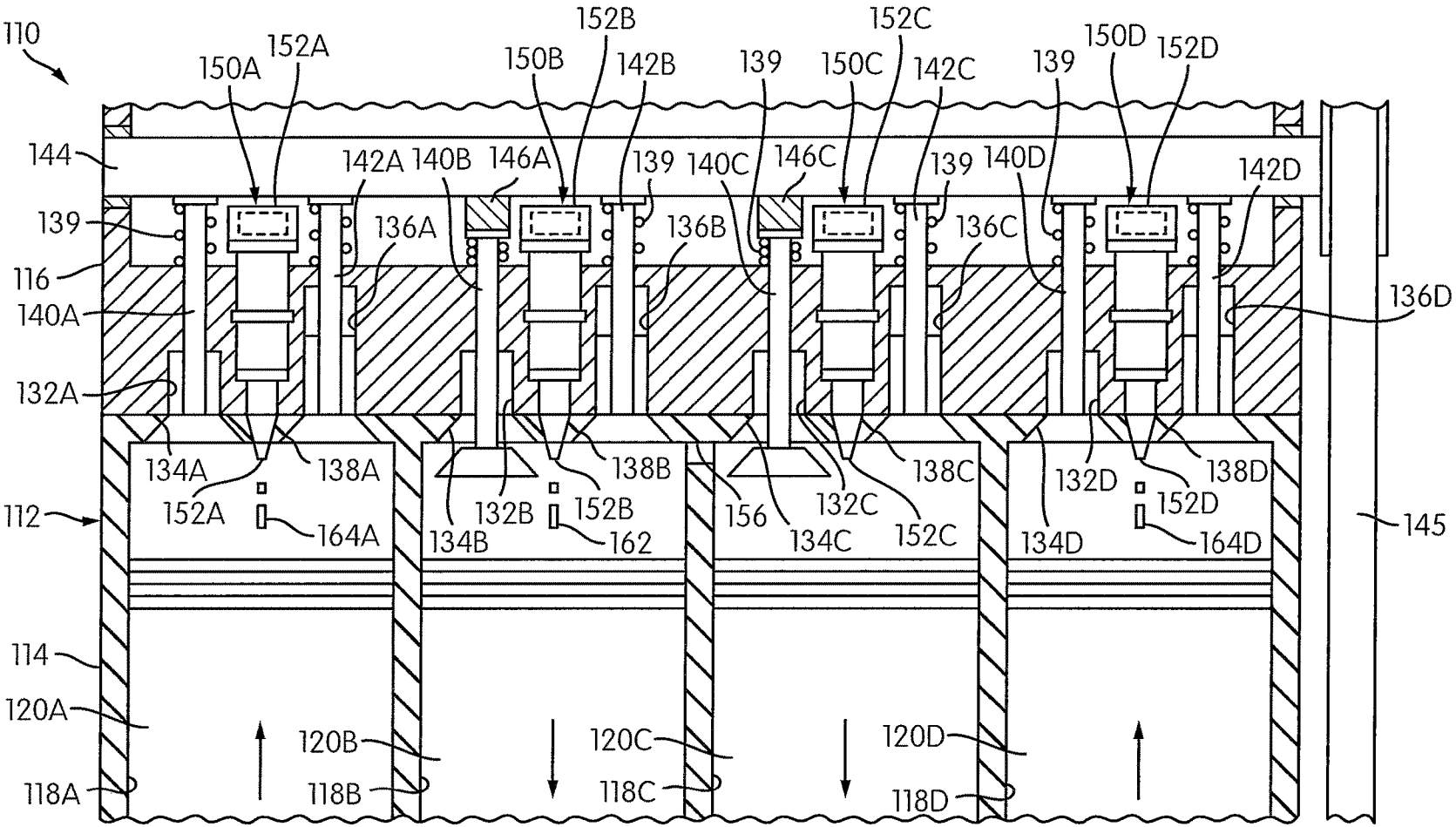
FIG. 6 is an enlarged horizontal sectional view of one end portion of the engine of FIG. 5 showing the position of the parts in mid stroke.
Figure 7:
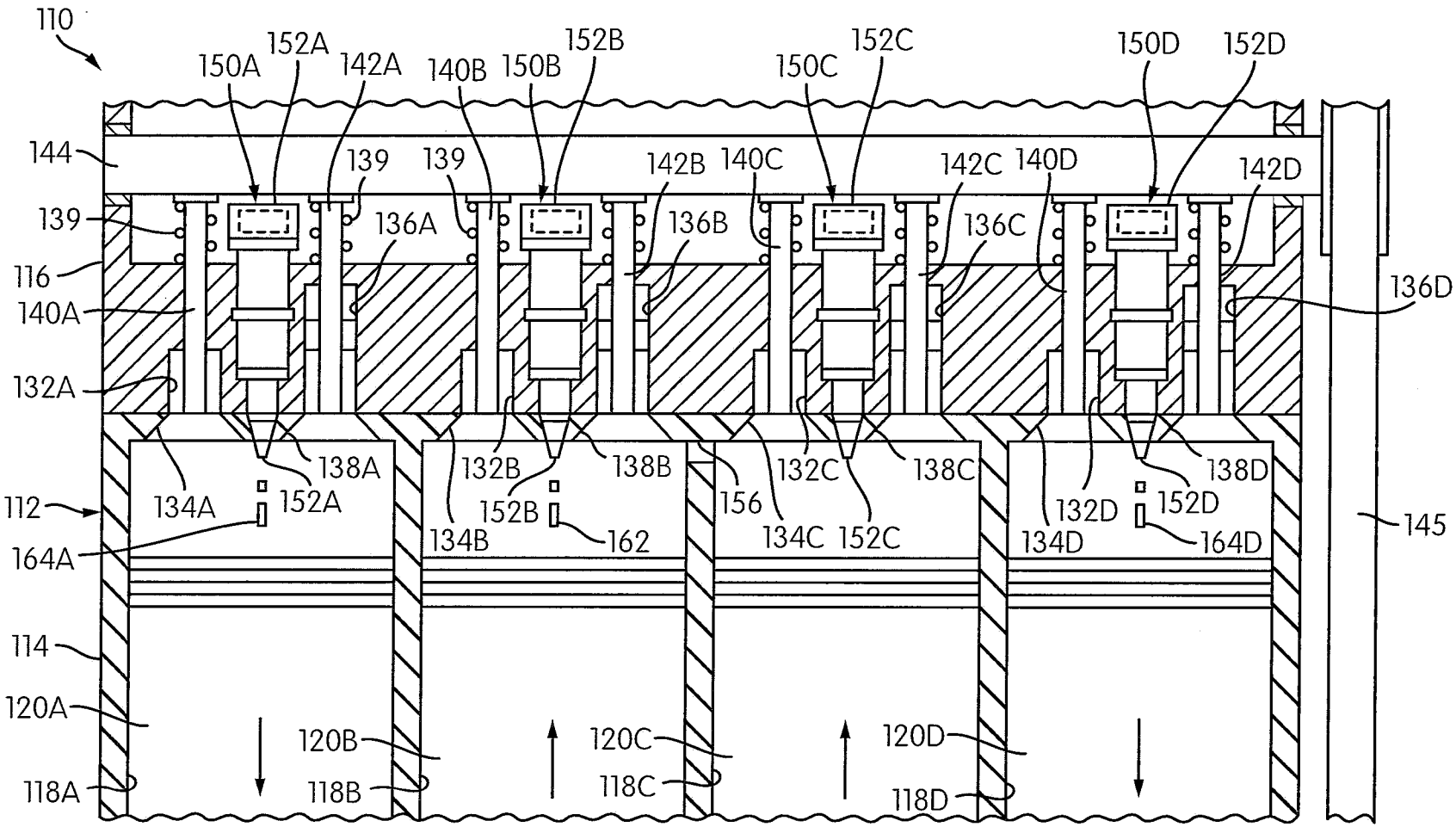
FIG. 7 is a view similar to FIG. 6 showing the position of the parts after a 180° turn of the output shaft from the position show in FIG. 6 shaft.
Figure 8:
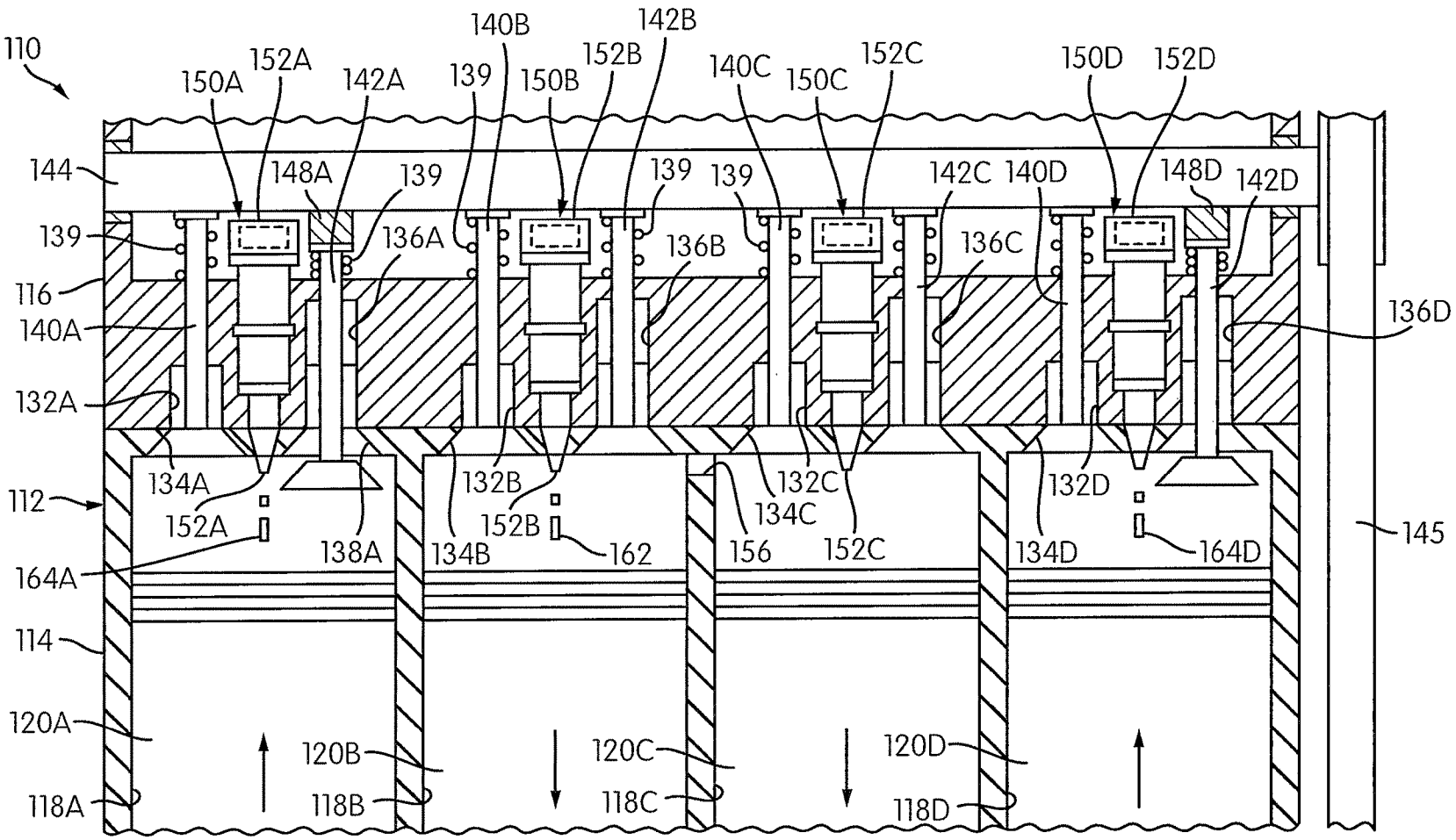
FIG. 8 is a view similar to FIG. 5 showing the position of the parts after another 180° turn of the output shaft from the position shown in FIG. 7.
Figure 16:
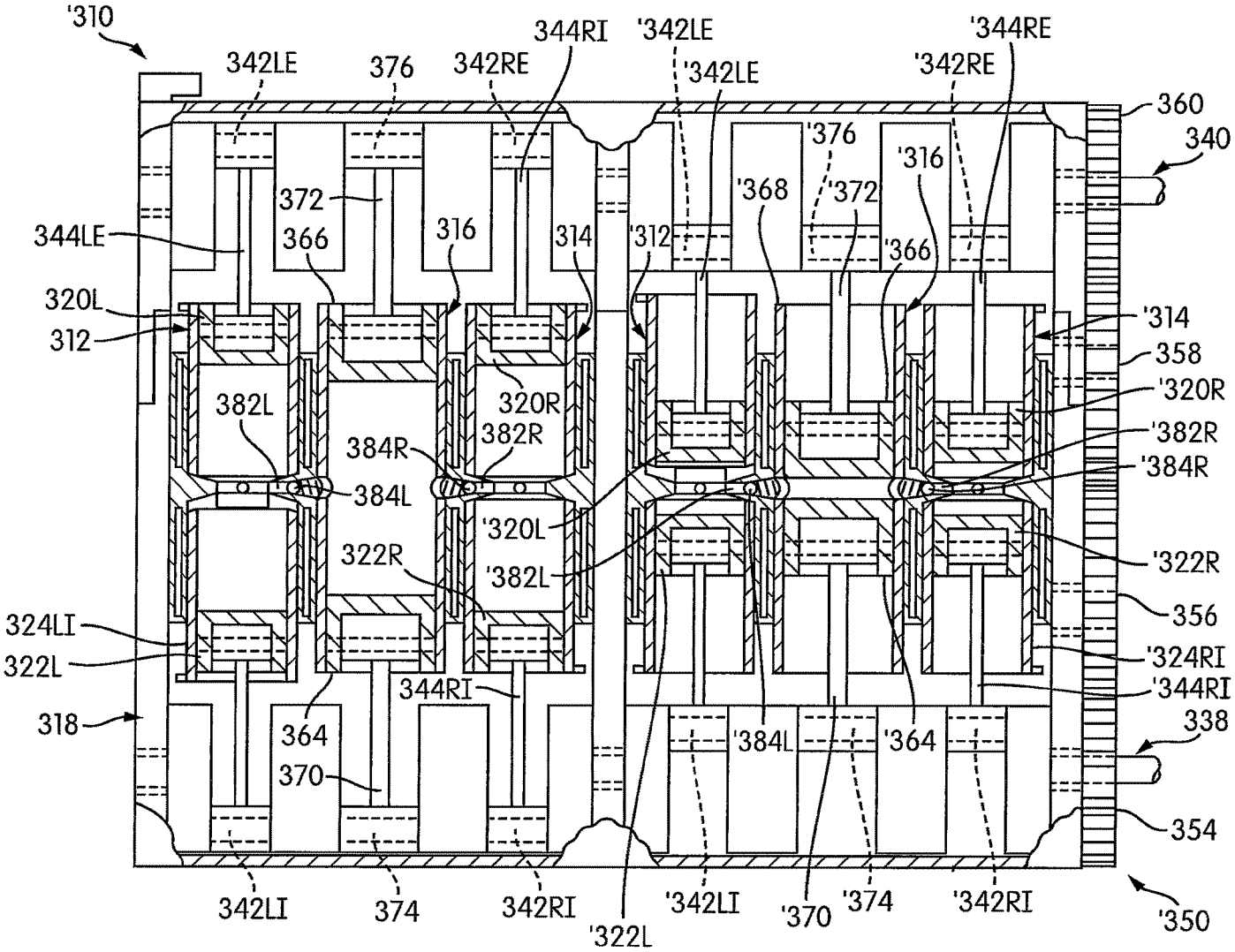
FIG. 16 is a view similar to FIG. 5 showing another modification.

FIG. 16 schematically illustrates a modified engine $^1$310 wherein like added parts are designated by the same reference characters with a prime added in the front of the numeral. FIG. 6 schematically shows the three added piston and cylinder assemblies $^1$312, $^1$314, and $^1$316 in an inline relationship with respect to the first three assemblies 312, 314 and 316. It will be noted that the crankshafts $^1$338 and $^1$340 are integral with respect to the crankshafts 338 and 340 and configured to be 180° out of phase with respect thereto.

The reference herein to a computer, programming, or software may be substituted by any type of controller, including those where the functionality is provided in circuitry with or without the use of software.

The foregoing embodiments have been provided solely to illustrate the structural and functional principles of the present invention, and are not intended to be limiting. To the contrary, the present application is intended to encompass all modifications, substitutions, and alterations within the spirit and scope of the appended claims.

What is claimed is:

1. An internal combustion engine comprising:

a frame structure, a pair of piston and cylinder assemblies mounted on said frame structure including two side by side cylinders and pistons movably mounted in said cylinders for simultaneous movements through repetitive cycles, each including simultaneous compression strokes and immediately following simultaneous power drive strokes, an output shaft connected with said pistons so as to be moved by said pistons through a predetermined number of rotational movements during each cycle of movement of said pistons, a fuel injection and charge ignition system including an injector operatively associated with one of said piston and cylinder assemblies and another injector operatively associated with the other of said piston and cylinder assemblies, said fuel injection and charge ignition system being constructed and arranged in one mode of operation to establish at the beginning of the simultaneous power drive strokes of the pistons of both cylinders a charge of ignitable compressed air fuel mixture in one of said cylinders and a charge of unignitable compressed air in the other of said cylinders, a passage between said side-by-side cylinders constructed and arranged to communicate the high pressure conditions created by the ignition of the charge of ignitable air-fuel mixture in said one of said cylinders with the charge of compressed air to raise the pressure in the other of said cylinders during said one mode to move the number of said pistons associated therewith through the simultaneous drive stroke thereof;

said fuel injection and charging system being constructed and arranged to selectively operate in a second mode of operation to establish at the beginning of the simultaneous power drive strokes a charge of ignitable compressed air-fuel mixture in both cylinders so that the ignition of both ignitable charges moves the pistons of both assemblies together through the simultaneous power drive strokes thereof;

wherein said pair of piston and cylinder assemblies constitute an inner two of four in line piston and cylinder assemblies which also include two outer piston and cylinder assemblies including two outer cylinders and two outer pistons mounted in said two outer cylinders for simultaneous movements through repetitive cycles, each including simultaneous compression strokes and immediately following simultaneous power drive strokes, said two outer pistons being connected to said output shaft so that the repetitive movement cycles thereof are 180° out of phase with respect to the repetitive movement cycles of said first mentioned pistons, said fuel injecting and charge ignition system including two outer fuel injectors operatively associated with said two outer cylinders for causing simultaneous ignition of charges of compressed air-fuel mixture therein to move the two outer pistons through simultaneous drive strokes during each movement cycle thereof.

2. An internal combustion engine comprising:

a frame assembly;

first and second crankshaft driven piston and cylinder assemblies in said frame assembly valved to go through consecutive four stroke cycles during two crankshaft revolutions with the cycles being 180° out of phase with respect to one another, each cycle including a compression stroke followed immediately by a firing stroke;

a third crankshaft driven piston and cylinder assembly in said frame assembly valved to go through a two stroke cycle during each crankshaft revolution, each cycle including a compression stroke followed immediately by a firing stroke;

the 180° out of phase firing strokes of said first and second piston cylinder assemblies being simultaneous with a firing stroke of said third piston and cylinder assembly;

a fuel feeding and firing system for said piston and cylinder assemblies selectively operable (1) in a normal mode to feed fuel and fire the fuel fed into each piston and cylinder assembly to accomplish the firing strokes thereof, and (2) in a fuel saving mode to feed fuel and fire the fuel fed into the first and second assemblies only to accomplish consecutive firing strokes thereof;

the third piston and cylinder assembly during the fuel saving mode of operation being communicated alternately with the firing stroke of the first and second piston and cylinder assemblies so as to be acted on by the high pressure conditions thereof.

3. An internal combustion engine as defined in claim 2 wherein each piston and cylinder assembly includes opposed pistons driven by opposed crankshafts.

4. An internal combustion engine as defined in claim 2 wherein three similar piston and cylinder assemblies are included which operate 180° out of phase with respect to the three first mentioned piston and cylinder assemblies.

5. An internal combustion engine as defined in claim 4 wherein said three similar piston and cylinder assemblies are disposed in opposed relation to the first mentioned three piston and cylinder assemblies, and include pistons driven by one of said opposed crankshafts and opposed pistons driven by a third crankshaft, forming an opposed crankshaft to said one crankshaft.

6. An internal combustion engine as defined in claim 4 wherein said three similar piston and cylinder assemblies are disposed in an inline relationship with the first mentioned three assemblies so as to have common crankshafts.

7. An internal combustion engine as defined in claim 4 wherein each piston and cylinder assembly includes opposed pistons driven by opposed crankshafts.

8. An internal combustion engine as defined in claim 7 wherein said opposed crankshafts are mounted for relative movement toward and away from one another during operation.

9. An internal combustion engine as defined in claim 8 wherein said fuel feeding and firing system includes a fuel-air mixture injector assembly for each assembly and a spark plug energizable to fire the fuel-air mixture of each injector assembly.

10. An internal combustion engine as defined in claim 8 wherein said fuel feeding and firing system includes for each assembly a fuel injector operable to establish the firing stroke thereof by injecting fuel into a sufficiently high compression pressure condition to cause spontaneous combustion firing.

11. An internal combustion engine as defined in claim 10 wherein said first and second piston and cylinder assemblies are valved by the movement of opposed cylinder sections moving in opening and closing relation to an inlet and outlet respectively.

12. An internal combustion engine as defined in claim 11 wherein said third piston and cylinder assembly is valved by piston movement in opening and closing relation to a cylinder inlet and outlet.

13. A method of operating an internal combustion engine selectively in one of two modes, the internal combustion engine comprising two piston and cylinder assemblies having combustion chambers fired in four stroke cycles 180° out of phase with respect to one another and a third piston and cylinder assembly having a combustion chamber fired in a two stroke cycle, the method comprising:

cutting off the fuel to the combustion chamber of the third assembly, and alternately, communicating the combustion chamber of the third assembly to the combustion chamber of the first and second assemblies during firing so that the increased pressure conditions created by the firing in each first and second assembly is used to move the third assembly through a drive stroke simultaneous with a drive stroke of one of the first or second assemblies.

14. An internal combustion engine comprising:

a frame structure;

at least two piston and cylinder assemblies in said frame structure, said at least two assemblies including closely spaced combustion chambers and pistons movably connected with a crankshaft for simultaneous movements toward and away from said combustion chambers through repetitive cycles each including simultaneous compression strokes during which air in the assemblies is compressed into the combustion chambers by movement of the pistons toward the combustion chambers;

the cycle of one of said assemblies occurring during two crankshaft revolutions and includes an intake stroke immediately before said compression stroke and an exhaust stroke immediately after said power stroke;

the cycle of the other of said assemblies occurring during one crankshaft revolution and includes a purge of products of combustion following the power stroke by the insertion of a charge of gas under pressure prior to the compression stroke;

the combustion chambers of said assemblies being communicated so that a firing during the power stroke of said one assembly produces increased pressure conditions in the combustion chamber thereof which when communicated to the air pressure in the combustion chamber of other of the said assemblies accomplishes the power stroke of the other of said assemblies.

15. An internal combustion engine as defined in claim 14 wherein the gas and under pressure inserted in the cycle of said other assembly is air and said other assembly includes a fuel injector selectively operable in a first mode to inject fuel into said air so that the resultant mixture of air and fuel when ignited accomplishes the power stroke thereof and in a second mode to not inject fuel into the air so that the increase in pressure in the combustion chamber of said one assembly resulting from the firing of the air-fuel mixture therein when communicated with the combustion chamber of said other assembly accomplishes the power stroke thereof.

16. An internal combustion engine as defined in claim 15 wherein during said first mode the ignition of the mixture of air and fuel in the combustion chamber of said other assembly is accomplished by the communication of the firing in the combustion chamber of said one assembly.

17. An internal combustion engine as defined in claim 14, wherein said frame structure includes a third piston and cylinder assembly constructed as said one assembly to have a repetitive two crankshaft revolution cycle like said one assembly which is 180° out of phase with respect to the cycle of said one assembly, said third assembly having a combustion chamber closely spaced by and communicating with the combustion chamber of said other assembly so that when said injector is selectively operable in said second mode increased pressure conditions resulting from a firing in the combustion chamber of said third assembly accomplishes alternately every other power stroke of said other assembly and immediately following power strokes during which the pistons simultaneously move away from the combustion chambers, the compressed air in one of said at least two assemblies being ignited with a mixture of fuel therewith so that the power stroke of said one assembly is accomplished under increased pressure conditions resulting from the firing of the air fuel mixture, the combustion chambers of said one assembly being communicated with a combustion chamber of another of said at least two assemblies so that the increased pressure conditions in said one assembly are communicated with said another assembly to accomplish a drive stroke thereof.

18. An internal combustion engine comprising:

a frame structure having a plurality of piston and cylinder assemblies therein, each of said assemblies comprising (1) a cylinder having a combustion chamber therewith, (2) a crankshaft connected piston movable in the cylinder through repetitive strokes toward and away from the combustion chamber with each stroke occurring during a 180° rotational movement of the associated crankshaft and a consecutive number of strokes completing a repeating cycle which includes a piston compression stroke immediately followed by a piston drive stroke, (3) a fuel injector constructed and controlled to inject an amount of fuel into the cylinder thereof during each cycle, and (4) valving structure constructed and arranged to cause sequential events to occur within the cylinder thereof including an intake event, a compression event during the piston compression stroke, a drive event during the piston drive stroke, and an exhaust event, said plurality of assemblies providing a plurality of cooperating pairs of assemblies, each pair having simultaneous cylinder drive events occurring during simultaneous piston drive strokes and a passage providing communication between the cylinders thereof to allow pressurized gas flow from the cylinder of one of the pair of assemblies to the other, the fuel injectors of each pair of assemblies being computer controlled to selectively operate in a shared power mode wherein the fuel injectors thereof inject an amount of fuel in the cylinder of only one of the pairs of assemblies during each cycle so that the pair of assemblies have simultaneous shared power drive events in the cylinders thereof during the simultaneous drive strokes thereof by virtue of the increased pressure conditions created in the cylinder which received the only injection being communicated to the other cylinder by said passage.

19. An internal combustion engine according to claim 18, wherein the fuel injectors of each pair of assemblies are also computer controlled to selectively operate in a dual-power mode wherein the fuel injectors thereof inject fuel in both cylinders of the pair of assemblies so that during each cycle so that the pair of assemblies have simultaneous directed fired power drive events.

20. An internal combustion engine as defined in claim 19, wherein one assembly of each pair of assemblies has a cylinder of a volume greater in comparison with the volume of the cylinder of the other assembly and a two stroke cycle which is completed during the piston compression stroke and the following piston drive stroke with the intake and exhaust events occurring simultaneously during an ending portion of the piston drive stroke and beginning portion of the piston compression stroke, and wherein the other assembly of each pair of assembly has a four stroke cycle in which the intake event occurs in a piston intake stroke immediately preceding the piston compression stroke and the exhaust event occurs in a piston exhaust stroke immediately following the piston drive stroke.

21. An internal combustion engine as defined in claim 20, wherein the plurality of assemblies provide four cooperating pairs of assemblies in which the cycles of piston strokes of the four pairs are related so that when the injectors of all four pairs are computer controlled to operate in the dual-power mode the eight injections result in a pair of simultaneous directly fired power drive events occurring every 180° of crankshaft rotational movement, and when the injectors of all four pairs are computer controlled to operate in the shared power mode the four injections result in a pair of simultaneous shared power drive events occurring every 180° of crankshaft rotational movement.

22. An internal combustion engine as defined in claim 21, wherein the plurality of assemblies are arranged in two rows of three side by side assemblies, each row including a center assembly having the cylinder of greater volume and the two stroke cycle and an outer assembly on each side of the center assembly each having the cylinder of lesser volume and the four stroke cycle, each outer assembly and the center assembly therebeside providing a pair of cooperating assemblies, the cylinder of the other center assembly having an inlet opening and an outlet opening and the valving structure of the center assembly being constructed and arranged to communicate the inlet and outlet openings internally of the cylinder and to allow the simultaneous intake and exhaust events to occur through the openings and to close communication between the inlet and outlet openings to allow the compression and drive events to occur within the cylinder between the inlet and outlet openings.

23. An internal combustion engine as defined in claim 22, wherein the number of pistons in each cylinder is two, the two pistons in each cylinder being movable toward and away from each other in moving through strokes toward and away from a centrally located combustion chamber provided within the cylinder.

24. An internal combustion engine as defined in claim 20, wherein the intake event which occurs during the intake stroke preceding the compression stroke is an intake of air which is compressed to an autoignition pressure during the following compression stroke and ignited when an amount of fuel is injected therein.

25. An internal combustion engine as defined in claim 20, wherein the valving structure for each of the two stroke assemblies includes an inlet opening leading into one end of the cylinder thereof and an outlet opening leading from an opposite end of the cylinder, the valving structure being constructed and arranged to communicate the inlet and outlet openings internally of the cylinder and to allow the simultaneous intake and exhaust events to occur through the openings and to close communication between the inlet and outlet openings to allow the compression and drive events to occur within the cylinder between the inlet and outlet openings.

26. An internal combustion engine as defined in claim 25, wherein the outlet opening for each cylinder is formed in a wall defining the cylinder and the valving structure includes piston portions movable within the cylinder past the outlet opening.

27. An internal combustion engine comprising:

a frame structure, at least one crankshaft;

a pair of piston and cylinder assemblies mounted on said frame structure including two side by side cylinders and crankshaft-connected pistons movably mounted in said cylinders for simultaneous movements through repetitive cycles for affecting crankshaft rotation, each including simultaneous compression strokes and immediately following simultaneous power drive strokes, a fuel injection and charge ignition system including an injector operatively associated with one of said piston and cylinder assemblies, said fuel injection and charge ignition system being constructed and arranged for operation in a shared power drive mode for said pair to establish at the beginning of the simultaneous power drive strokes of the pistons of both cylinders a charge of ignitable compressed air fuel mixture in only one of said side-by-side cylinders and a charge of unignitable compressed air in the other of said side-by-side cylinders, and a passage between said side-by-side cylinders constructed and arranged to communicate the high pressure conditions created by the ignition of the charge of ignitable air-fuel mixture in said one of said cylinders with the charge of compressed air to raise the pressure in the other of said cylinders to move both pistons of said pair through the simultaneous drive strokes thereof in said shared power drive mode.

28. An internal combustion engine according to claim 27, wherein the engine has a plurality of said pairs, the pistons of each pair being connected to same crankshaft.

29. An internal combustion engine as defined in claim 27, wherein said fuel injection and charge ignition system includes an injector operatively associated with each of said pair of piston and cylinder assemblies, said engine further comprising a controller configured to control said fuel injection and charge system including the injectors in the shared power drive mode for said pair to selectively establish the charge of ignitable compressed air fuel mixture in only one of said side-by-side cylinders.

30. An internal combustion engine according to claim 29, wherein the controller is also configured to select between the shared power drive mode and a dual-power drive mode for said pair, the controller being configured to control said fuel injection and charge system including the injectors in the dual-power drive mode for said pair to selectively establish the charge of ignitable compressed air fuel mixture in both of said side-by-side cylinders.

31. An internal combustion engine according to claim 30, further comprising a check valve in said passage for limiting said communication of the high pressure conditions in said shared power drive mode to only one direction from said one cylinder to said other cylinder.

32. An internal combustion engine according to claim 30, wherein one assembly of the pair of assemblies has a cylinder of a volume greater than the volume of the cylinder of the other assembly of the pair.

33. An internal combustion engine according to claim 32, further comprising a check valve in said passage for limiting said communication of the high pressure conditions in said shared power drive mode to only one direction from said one cylinder to said other cylinder.

34. An internal combustion engine according to claim 32, wherein the one assembly has a two stroke cycle which is completed during the piston compression stroke and the following piston drive stroke with the intake and exhaust events occurring simultaneously during an ending portion of the piston drive stroke and a beginning portion of the piston compression stroke, respectively; and wherein the other assembly has a four stroke cycle in which the intake event occurs in a piston intake stroke immediately preceding the piston compression stroke and the exhaust event occurs in a piston exhaust stroke immediately following the piston drive stroke.

35. An internal combustion engine according to claim 34, further comprising a check valve in said passage for limiting said communication of the high pressure conditions in said shared power drive mode to only one direction from said one cylinder to said other cylinder.

36. An internal combustion engine according to claim 30, wherein the engine has eight piston and cylinder assemblies comprising said pair.

37. An internal combustion engine according to claim 36, wherein the eight piston and cylinder assemblies comprises two of said pair.

38. An internal combustion engine according to claim 37, wherein the eight piston and cylinder assemblies are arranged in two banks of four piston and cylinder assemblies.

39. An internal combustion engine according to claim 38, wherein each bank includes one of said pair of piston and cylinder assemblies.

40. An internal combustion engine according to claim 30, wherein the one assembly has a two stroke cycle which is completed during the piston compression stroke and the following piston drive stroke with the intake and exhaust events occurring simultaneously during an ending portion of the piston drive stroke and a beginning portion of the piston compression stroke, respectively; and wherein the other assembly has a four stroke cycle in which the intake event occurs in a piston intake stroke immediately preceding the piston compression stroke and the exhaust event occurs in a piston exhaust stroke immediately following the piston drive stroke.

41. An internal combustion engine according to claim 40, further comprising a check valve in said passage for limiting said communication of the high pressure conditions in said shared power drive mode to only one direction from said one cylinder to said other cylinder.

42. An internal combustion engine as defined in claim 29 wherein each piston and cylinder assembly includes a pair of opposed piston movable toward and away from one another in one cylinder.

43. An internal combustion engine as defined in claim 29 wherein each piston and cylinder assembly consists of a single piston in a single cylinder.

44. An internal combustion engine according to claim 27, wherein the at least one crankshaft is two crankshafts.

45. An internal combustion engine according to claim 44, wherein the two crankshafts are a first crankshaft and a second crankshaft, the pistons of said pair being connected to the first crankshaft for affecting rotation thereof, the engine further comprising a further said pair of piston and cylinder assemblies having the pistons thereof connected to the second crankshaft for affecting rotation thereof and a further said passage between the side-by-side cylinders thereof, the fuel injection and charge system including a further injector operatively associated with one of said further piston and cylinder assemblies for operation in the shared power drive mode for the further pair.

46. An internal combustion engine according to claim 27, wherein the pistons of said pair are connected to the same crankshaft for affecting rotation thereof.

47. An internal combustion engine defined in claim 46 wherein said pair of piston and cylinder assemblies constitute an inner two of a plurality of in-line piston and cylinder assemblies which also comprise outer piston and cylinder assemblies including outer cylinders and outer pistons mounted in said outer cylinders for simultaneous movements through repetitive cycles, each outer piston and cylinder assembly including simultaneous compression strokes and immediately following simultaneous power drive strokes, said outer pistons being connected to said same crankshaft so that the repetitive movement cycles thereof are out of phase with respect to the repetitive movement cycles of said inner two piston and cylinder assemblies, said fuel injecting and charge ignition system comprising outer injectors operatively associated with each said outer cylinder for establishing charges of compressed air-fuel mixture therein for ignition to move the outer pistons through drive strokes during each movement cycle thereof.

48. An internal combustion engine as defined in claim 47, wherein said plurality of in-line piston and cylinder assemblies consists of four of said piston and cylinder assemblies and said outer piston and cylinder assemblies consist of two of said outer piston and cylinder assemblies.

49. An internal combustion engine as defined in claim 47 wherein said plurality of in-line piston and cylinder assemblies form one bank of assemblies on one side of said output shaft and a second bank of in-line piston and cylinder assemblies of similar construction and arrangement are disposed on an opposite side of said same crankshaft.

50. An internal combustion engine according to claim 27, wherein the engine has eight piston and cylinder assemblies comprising said pair.

51. An internal combustion engine according to claim 50, wherein the eight piston and cylinder assemblies comprises two of said pair.

52. An internal combustion engine according to claim 51, wherein the eight piston and cylinder assemblies are arranged in two banks of four piston and cylinder assemblies.

53. An internal combustion engine according to claim 52, wherein each bank includes one of said pair of piston and cylinder assemblies.

* * * * *